US006670976B2

(12) United States Patent
Watanabe

(10) Patent No.: US 6,670,976 B2
(45) Date of Patent: Dec. 30, 2003

(54) METHOD OF AND APPARATUS FOR CONTROLLING THERMAL HEAD

(75) Inventor: Hidetoshi Watanabe, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/212,267

(22) Filed: Aug. 6, 2002

(65) Prior Publication Data

US 2003/0025753 A1 Feb. 6, 2003

(30) Foreign Application Priority Data

Aug. 6, 2001 (JP) ..... 2001-237333

(51) Int. Cl.[7] ..... B41J 2/38
(52) U.S. Cl. ..... 347/186; 400/120.08
(58) Field of Search ..... 347/185, 186; 400/120.08

(56) References Cited

U.S. PATENT DOCUMENTS 4,859,093 A * 8/1989 Plotnick ..... 347/186

FOREIGN PATENT DOCUMENTS

| | | | | |
|---|---|---|---|---|
| JP | 55164177 A | * | 12/1980 | ..... B41J/3/20 |
| JP | 61078671 A | * | 4/1986 | ..... B41J/3/20 |
| JP | 61239966 A | * | 10/1986 | ..... B41J/3/20 |
| JP | 62164568 A | * | 7/1987 | ..... B41J/3/20 |
| JP | 63134260 A | * | 6/1988 | ..... B41J/3/20 |

* cited by examiner

*Primary Examiner*—Huan H. Tran
(74) *Attorney, Agent, or Firm*—Nixon Peabody LLP; Donald R. Studebaker

(57) ABSTRACT

A thermal head is provided with a plurality of heater elements which are arranged in a main scanning direction. The heater elements are selectively energized according to black and white information for the pixels to be formed by the respective heater elements. Each heater element corresponding to a pixel the black and white information for which is white is heated to an auxiliary temperature according to the black and white information for pixels adjacent to the pixel in the main scanning direction.

8 Claims, 22 Drawing Sheets

METHOD OF AND APPARATUS FOR CONTROLLING THERMAL HEAD

BACKGROUND OF THE INVENTION

1. Field of the Invention

This invention relates to a method of and an apparatus for controlling a thermal head, for instance, in a heat-sensitive plate making apparatus, and more particularly to a method of and an apparatus for controlling heater elements in such a thermal head.

2. Description of the Related Art

There has been known a heat-sensitive plate making apparatus which makes a plate (e.g., a stencil) by thermally perforating a plate material by selectively energizing some of heater elements of a thermal head arranged in a main scanning direction while moving the plate material in a sub-scanning direction relatively to the thermal head. In such a plate making apparatus, heat history control, in which the time for which each heater elements is energized is controlled according to its heat history, is carried out. For example, when a square area of the plate material is to be perforated in order to print a square such as shown in FIG. 21A, imperforation can occur at an upper edge portion 72 and left and right side edge portions 71 of the square area as shown in FIG. 21B if the heater elements of the thermal head corresponding to the square area is uniformly energized without performing the heat history control. This is probably because the heater elements corresponding to the left and right side edge portions 71 cannot be sufficiently heated since heater elements on the outer sides of the left and right side edge portions 71 are not at an elevated temperature and because the heater elements corresponding to the upper edge portion 72 are not heated at the preceding perforating timing. On the other hand, if all the heater elements corresponding to the square area are energized for a longer time so that even the heater elements corresponding to the upper edge portion 72 and the left and right edge portions 71 are heated to a temperature sufficient to perforate the plate material, the perforations corresponding to the area 73 in FIG. 21B will become too large in size though imperforation at the edge portions 71 and 72 can be prevented.

When the heat history control is performed so that when a certain pixel (will be referred to as "a pixel of current interest", hereinbelow) is a black spot which involves perforation of the plate material and at least one of the pixels adjacent to the pixel of current interest on opposite sides thereof and a pixel immediately preceding to the pixel of current interest is a white spot which does not involve perforation of the plate material, the heater element corresponding to the pixel of current interest is energized for a longer time, the heater elements corresponding to the edge portions 71 and 72 can be heated to a temperature equivalent to that of the heater elements corresponding to the area 73, whereby the perforations in the square area can be uniform in size as shown in FIG. 21C.

However such a heat history control is disadvantageous in that particular heater elements are repeatedly energized for a longer time than the other heater elements and the particular heater elements deteriorate in durability. For example, the heater elements corresponding to the edge portions 71 and 72 are energized for a longer time than the other heater elements during several perforations, and when a plurality of perforations arranged in a row in the sub-scanning direction are formed to print a thin line, one of the heater elements is continuously energized for a longer time.

Durability of particular heater elements deteriorates also in a heat history control where such particular heater elements are not energized for a longer time but are applied with a larger power per unit time. In other words, when power applied to particular heater elements is increased in order to prevent defective perforation due to fluctuation in heating temperature of the heater elements (the temperature to which the heater element is heated when energized), there is a fear that the thermal head can deteriorate in durability.

SUMMARY OF THE INVENTION

In view of the foregoing observations and description, the primary object of the present invention is to provide a method of and an apparatus for controlling a thermal head comprising a plurality of heater elements arranged in one direction so that fluctuation in heating temperatures of the heater elements can be suppressed and defective perforation can be prevented without deteriorating the durability of the thermal head.

In accordance with a first aspect of the present invention, there is provided a method of controlling a thermal head provided with a plurality of heater elements which are arranged in a main scanning direction, the method comprising the step of selectively energizing the heater elements according to black and white information for the pixels to be formed by the respective heater elements, wherein the improvement comprises the step of an auxiliary heating control in which each heater element corresponding to a pixel the black and white information for which is white is heated to an auxiliary temperature according to the black and white information for pixels adjacent to the pixel in the main scanning direction.

In accordance with a second aspect of the present invention, there is provided an apparatus for controlling a thermal head provided with a plurality of heater elements which are arranged in a main scanning direction, the apparatus comprising a heater control means which selectively energizes the heater elements according to black and white information for the pixels to be formed by the respective heater elements, wherein the improvement comprises that the heater control means is provided with an auxiliary heater control means which performs an auxiliary heating control in which each heater element corresponding to a pixel the black and white information for which is white is heated to an auxiliary temperature according to the black and white information for pixels adjacent to the pixel in the main scanning direction.

For example, when the thermal head is used in a heat-sensitive printer, the "black and white information" represents whether the pixel is to be black or white, and when the thermal head is used in a heat-sensitive plate making apparatus, the "black and white information" represents whether the pixel is to be perforated. In the former case, that the black and white information for the pixel is white means that the pixel should not be printed and in the latter case, that the black and white information for the pixel is white means that the pixel should not be perforated.

The heater control means may be further provided with a preheating heater control means which performs a preheating control in which each heater element corresponding to a pixel the black and white information for which is white is heated to a preheating temperature according to the black and white information for pixels adjacent to the pixel in a sub-scanning direction substantially perpendicular to the main scanning direction.

The auxiliary temperature or the preheating temperature means a temperature lower than a temperature at which the heater element can accomplish the expected objected, that is, a temperature at which the heater element cannot form a perforation through which the ink can pass (including the case where the plate material is not perforated at all) in the case where the thermal head is used in a heat-sensitive plate making apparatus and a temperature at which the heater element cannot form a black spot in the case where the thermal head is used in a heat-sensitive printer.

The heater control means may be further provided with a heat history heater control means which performs a heat history control in which each heater element corresponding to a pixel the black and white information for which is black is additionally heated on the basis of the black and white information for pixels adjacent to the pixel in the main scanning direction and/or a sub-scanning direction substantially perpendicular to the main scanning direction.

The auxiliary heater control means, the preheating heater control means and the heat history heater control means may be arranged to perform the heater control on the basis of the black and white information for pixels adjacent to said adjacent pixels and/or pixels positioned in an oblique direction thereof in addition to the black and white information for said adjacent pixels. Further, the auxiliary heating control and the heat history control may be performed at the same timing.

The thermal head may be used, for instance, in a heat-sensitive plate making apparatus, and the auxiliary heater control means may perform the auxiliary heating control so that each heater element corresponding to a pixel the black and white information for which is white is heated to an auxiliary temperature before heater elements corresponding to pixels the black and white information for which is black are heated to perforate the heat-sensitive plate material.

The thermal head may be arranged so that a set of heater elements which are contiguously arranged in the main scanning direction and/or the sub-scanning direction form a single pixel. In this case, the auxiliary heating control, the preheating control and the heat history control are performed on a set of heater elements corresponding to each pixel.

In accordance with the method and apparatus of the present invention, since even the heater elements which need not be heated to perforate the plate material (heater elements corresponding to white pixels: pixels the black and white information for which is white) are heated to a certain elevated temperature, the heating temperature of a heater element which corresponds to a black pixel (a pixel the black and white information for which is black) and which is adjacent to a heater element corresponding to a white pixel can be heated to a temperature close to a heating temperature of a heater element corresponding to a black pixel which is interposed between heater elements corresponding to black pixels, fluctuation in the heating temperature of the heater elements can be suppressed without deteriorating the durability of the thermal head. That is, when the thermal head is used in a heat-sensitive plate making apparatus, perforations can be uniform in size.

When the preheating control is performed in addition to the auxiliary heating control, a heater element which comes to correspond to a black pixel after a white pixel can be heated to a temperature close to a heating temperature of a heater element successively corresponding to two black pixels, whereby fluctuation in the heating temperature of the heater elements can be suppressed without deteriorating the durability of the thermal head. That is, when the thermal head is used in a heat-sensitive plate making apparatus, perforations can be further uniform in size.

When the heat history control in which each heater element corresponding to a black pixel is additionally heated on the basis of the black and white information for pixels adjacent to the pixel in the main scanning direction and/or a sub-scanning direction substantially perpendicular to the main scanning direction is performed in addition to the auxiliary heating control, a heater element which comes to correspond to a black pixel after a white pixel can be heated to a temperature close to a heating temperature of a heater element successively corresponding to two black pixels, whereby fluctuation in the heating temperature of the heater elements can be suppressed without deteriorating the durability of the thermal head. That is, when the thermal head is used in a heat-sensitive plate making apparatus, perforations can be further uniform in size.

When the auxiliary heating control and the heat history control are performed at the same timing, the time for performing the heat history control need not be reserved separately from the time for performing the auxiliary heating control and accordingly, elongation of the line cycle in the sub-scanning direction can be avoided.

When the thermal head is used in a heat-sensitive plate making apparatus and the auxiliary heater control means performs said auxiliary heating control prior to the timing at which heater elements corresponding to black pixels are heated to perforate the plate material, energy applied to the heater elements for the auxiliary heating can be efficiently used for perforation of the plate material.

Recently, there have been developed multiple-row thermal heads having heater elements arranged in a plurality of rows extending in the main scanning direction. In such a multiple-row thermal head, a plurality of contiguous heater elements correspond to one pixel though, in the conventional single-row thermal head, one heater element corresponds to one pixel. For example, in the multiple-row thermal head disclosed in our Japanese Unexamined Patent Publication No. 2000-326474, a pair of heater elements adjacent to each other in the main scanning direction are controlled according to an image data component for one pixel. Further, in the multiple-row thermal head disclosed in Japanese Unexamined Patent Publication No. 2000-238230, a plurality of heater elements adjacent to each other in the main scanning direction and the sub-scanning direction are controlled according to an image data component for one pixel.

FIGS. 22A and 22B respectively show multiple-row thermal heads, where one pixel is formed by a pair of heater elements adjacent to each other in the main scanning direction and FIG. 22C shows a conventional thermal head, where one pixel is formed by one heater element. In the conventional thermal head shown in FIG. 22C, a plurality of heater element assemblies, each comprising a heater element 84 formed on a straight lead electrode, are arranged side by side. In the multiple-row thermal head shown in FIG. 22A, a plurality of heater element assemblies, each comprising a pair of heater elements 81 formed on a lead electrode 80 on opposite sides of a central slit, are arranged side by side. In the multiple-row thermal head shown in FIG. 22B, a plurality of heater element assemblies, each comprising a pair of heater elements 83 formed on a U-shaped lead electrode 82, are arranged side by side. In the multiple-row thermal head shown in FIG. 22A, the heater elements 81 are connected in parallel and the heater element assembly is connected to a power source at the ends of the lead electrode 80 which are on the upper and lower sides of the heater elements 80. To the contrast, in the multiple-row thermal head shown in FIG. 22B, the heater elements 83 are connected in series and the heater element assembly is connected to a power source at the ends of the lead electrode 80 which are both on the upper side of the heater elements 83. Each heater element 81 or 83 are smaller in size than a heater element 84 of the conventional thermal head shown in FIG. 22C. Accordingly, when the recording medium is perforated at 300 dpi by the multiple-row thermal head shown in FIG. 22B, the diameter of each perforation is smaller than when the recording medium is perforated at 300 dpi by the conventional thermal head shown in FIG. 22C as shown in FIGS. 23A and 23B, whereby the amount of ink transferred to the printing paper can be smaller and offset can be prevented. In the case shown in FIG. 23B, the resolution in the sub-scanning direction is 600 dpi.

In such a multiple-row thermal head, there has been a problem that the heat history control on the multiple-row thermal head in order to prevent imperforation due to fluctuation in heating temperatures of the heater elements can result in oversized perforations. For example, when a square area of the plate material is to be perforated in order to print a square such as shown in FIG. 24A, imperforation can occur at an upper edge portion 86 and left and right side edge portions 87 of the square area as shown in FIG. 24B if the heater elements of the thermal head corresponding to the square area is uniformly energized as described above. When the heat history control is effected, heater elements corresponding to pixels in the upper edge portion 86 are energized for a longer time in order to first prevent occurrence of imperforation in the upper edge portion 86. Then heater elements corresponding to pixels in the left and right edge portions 87 are energized for a longer time in order to prevent occurrence of imperforation in the left and right edge portions 87. When the heater elements corresponding to pixels in the left and right edge portions 87 are energized for a longer time, the pixels formed by the outer one of the heater element pair can be successfully perforated. However, pixels formed by the inner one of the heater element pair can be oversized since the inner one of the heater element pair is heated to an excessively high temperature due to influence of increase in temperature of the surrounding heater elements and elongation in energizing time.

Even when a multiple-row thermal head where a plurality of heater elements arranged in the main scanning direction and/or the sub-scanning direction form one pixel is used, by effecting the auxiliary heating control, the heating temperature of a heater element which corresponds to a black pixel and which is adjacent to a heater element corresponding to a white pixel can be heated to a temperature close to a heating temperature of a heater element corresponding to a black pixel which is interposed between heater elements corresponding to black pixels, fluctuation in the heating temperature of the heater elements can be suppressed without deteriorating the durability of the thermal head and without generating oversized perforations. That is, when the thermal head is used in a heat-sensitive plate making apparatus, perforations can be uniform in size.

DESCRIPTION OF THE PREFERRED EMBODIMENTS

Figure 1:
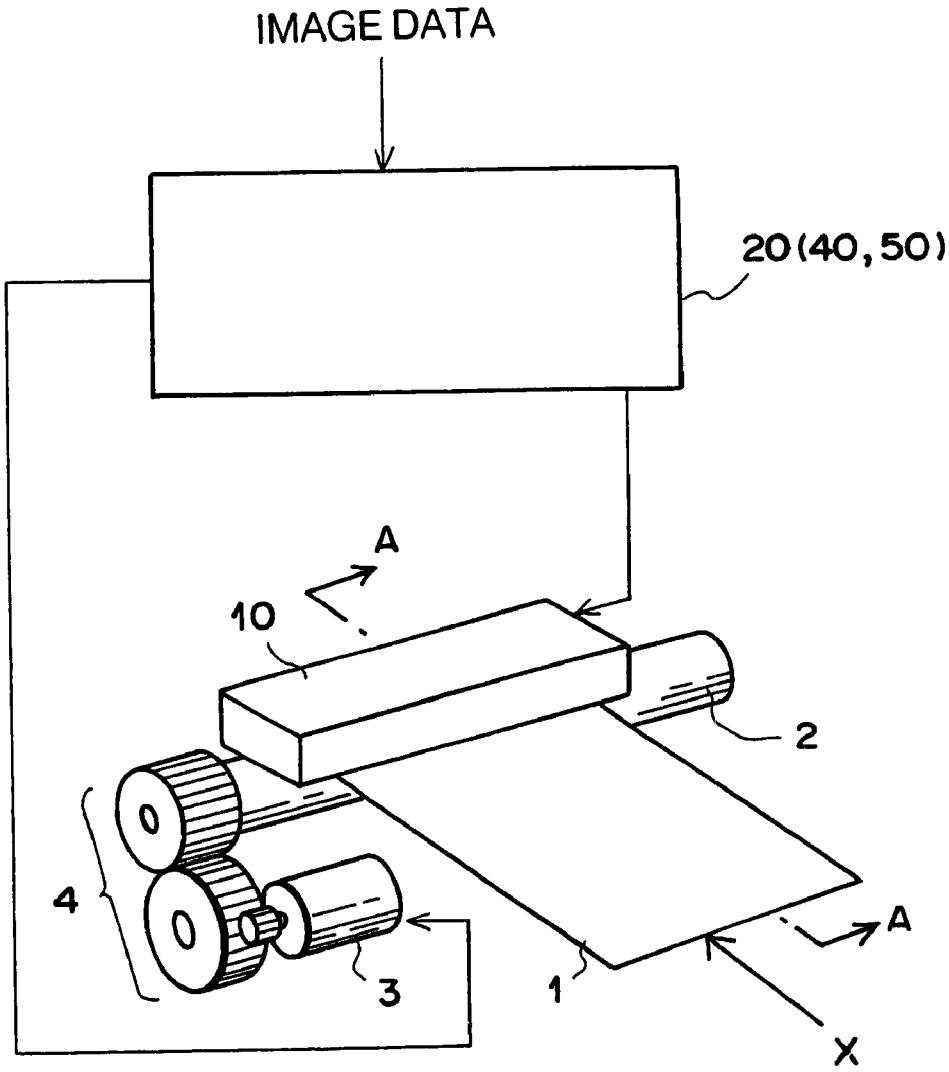
FIG. 1 is a schematic view showing a heat-sensitive stencil making apparatus in accordance with first to third embodiments of the present invention.

FIG. 1 shows a heat-sensitive stencil making apparatus in accordance with a first embodiment of the present invention.

In FIG. 1, the stencil making apparatus is for making a B4-size stencil and has a 400 dpi-thermal head 10 comprising 4096 heater elements arranged in a main scanning direction. In the stencil making apparatus, an auxiliary heating control, in which each heater element corresponding to a white pixel is heated to an auxiliary temperature according to the black and white information for pixels adjacent to the pixel in the main scanning direction, and a preheating control, in which each heater element corresponding to a white pixel is heated to a preheating temperature according to the black and white information for a pixel adjacent to the pixel in a sub-scanning direction, that is, a pixel corresponding to the same heater element 11 on the next line, are effected in combination.

As shown in FIG. 1, the stencil making apparatus comprises a platen roller 2 which conveys stencil material 1, a sub-scanning motor 3 which rotates the platen roller 2 by way of gears 4, a thermal head 10 which is brought into contact with the platen roller 2 as shown in FIG. 2 and removed therefrom by a pressing mechanism (not shown), and a controller 20 which outputs a control signal to the sub-scanning motor 3 and the thermal head 10.

The sub-scanning motor 3 is a step motor which rotates by one step per 3 ms, and the gear ratio of the gears 4 is set so that as the sub-scanning motor 3 rotates by one step, the platen roller 2 conveys the stencil material 1 by one pixel pitch, 63.5 $\mu$m.

Figure 2A:
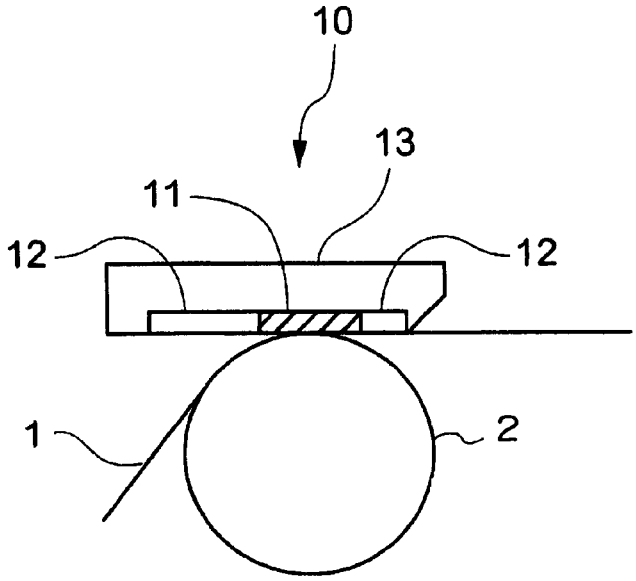
FIG. 2A is a side view of the thermal head used in the stencil making apparatus shown in FIG. 1.
Figure 2B:
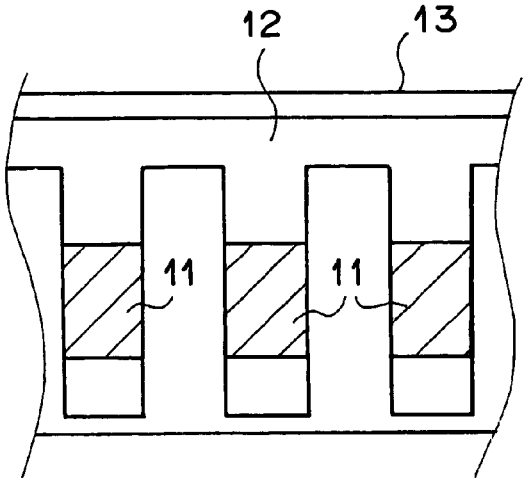
FIG. 2B is a plan view of the thermal head.
Figure 3:
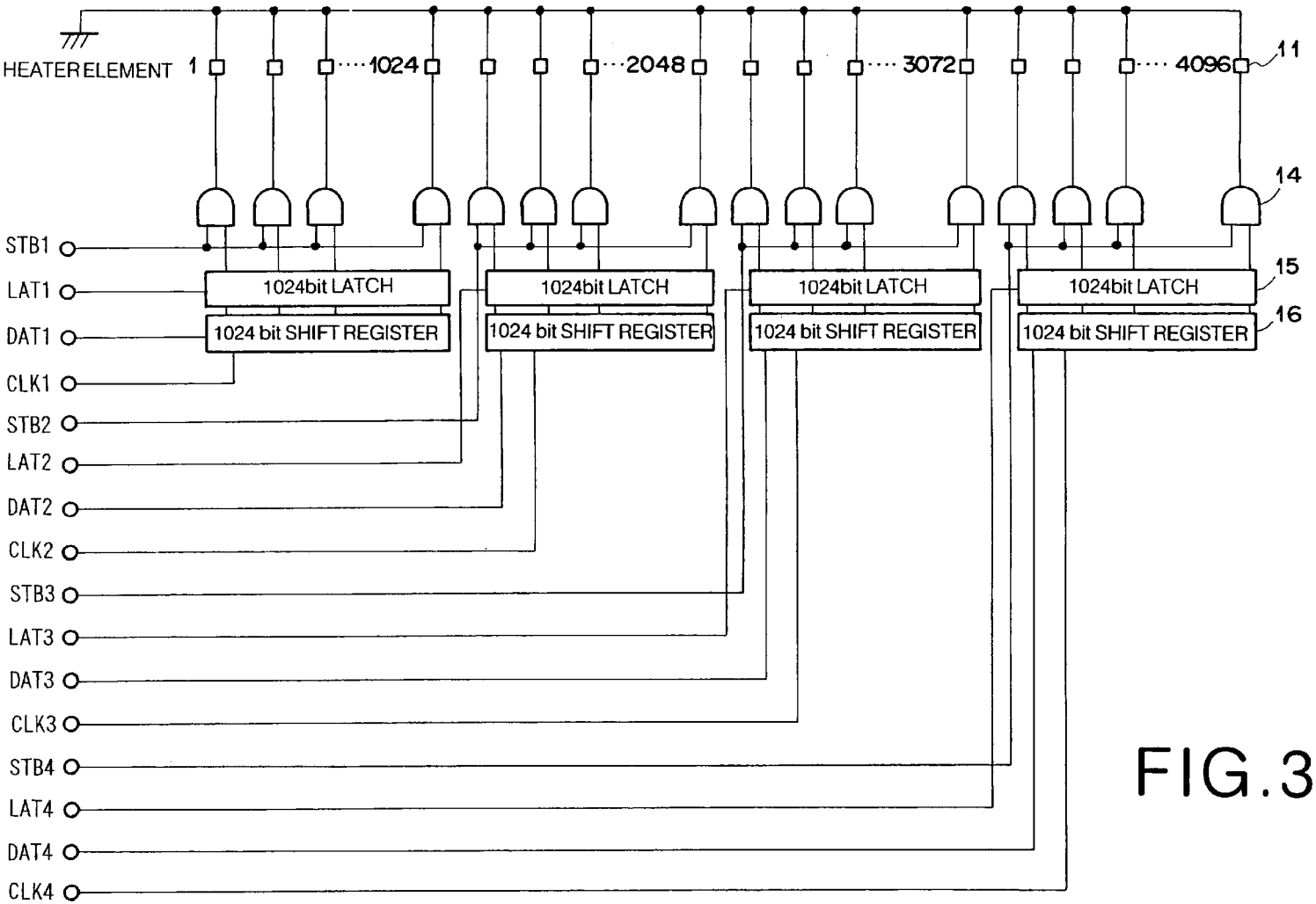
FIG. 3 is a circuit diagram of the thermal head.

The thermal head 10 is so-called a thin film thermal head as shown in FIGS. 2A and 2B. In FIGS. 2A and 2B, the thermal head 10 comprises a substrate 13 and a comb-tooth lead electrode 12 formed on the substrate 13. The comb-tooth lead electrode 12 has a plurality of teeth at regular intervals and a heater element 11 is mounted on each tooth. 4096 heater elements 11 are arranged in a row in the main scanning direction. The heater elements 11 are divided into 4 blocks, each formed by 1024 heater elements, as shown in FIG. 3. Each tooth is connected to an AND circuit 14 at one end and grounded at the other end. Each heater element block is provided with a latch section 15 and a shift register 16. Clock signals CLK1 to CLK4 and image data fractions DAT1 to DAT4 output from the controller 20 as will be described later are input into the respective shift registers 16 and latch signals LAT1 to LAT4 are input into the respective latch sections 15. Strobe signals STB1 to STB4 are input into the respective AND circuits 14.

Figure 4:
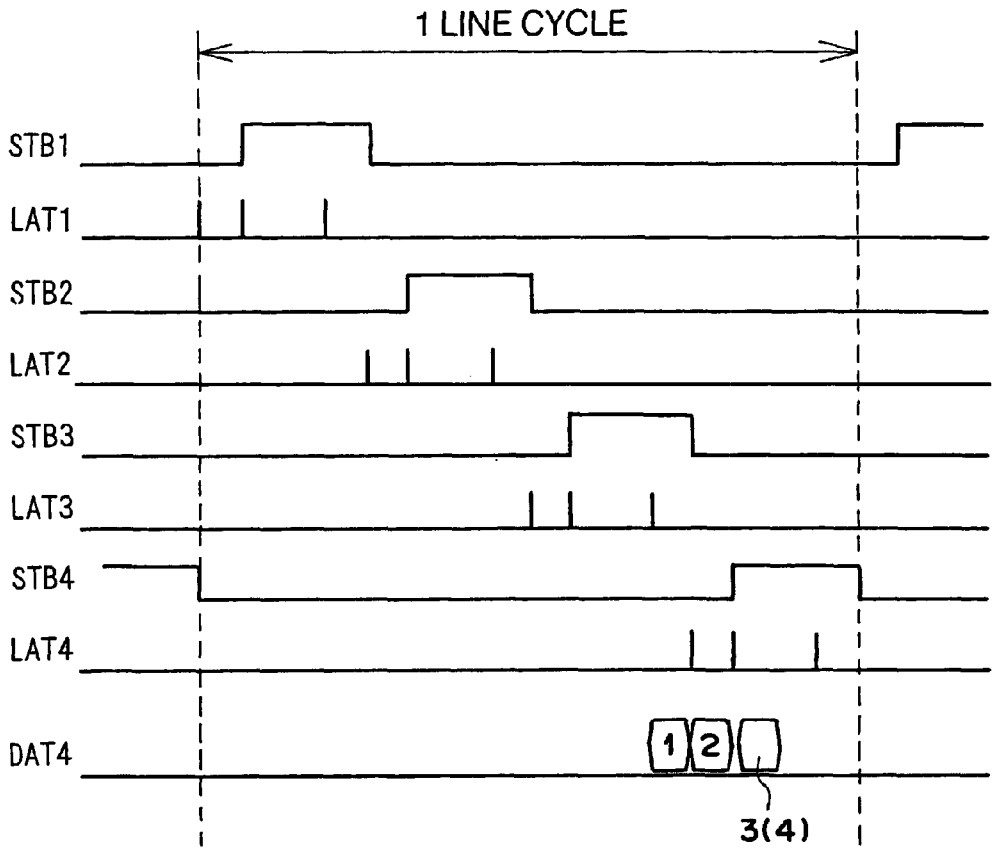
FIG. 4 is a view showing the control signals.

When actually making a stencil, the image data fractions DAT1 to DAT4 are input into the respective shift registers 16 as serial data. Each image data fraction is expanded in parallel and latched in the corresponding latch section 15 by each of the latch signals LAT1 to LAT4. The heater elements 11 are selectively energized according to the product of image data fraction (DAT1 to DAT4) latched in each latch section 15 and the respective strobe signals STB1 to STB4. Each of the image data fractions DAT1 to DAT4 comprises a black-and-white data for instructing whether the stencil material is perforated, and auxiliary heating data and preheating data which are to be described later. The signals are input into the heater element blocks at timings determined block by block as shown in FIG. 4. Data 1 on DAT4 in FIG. 4 represents the auxiliary heating data, data 2 represents the black-and-white data and data 3 represents the preheating data.

Figure 5:
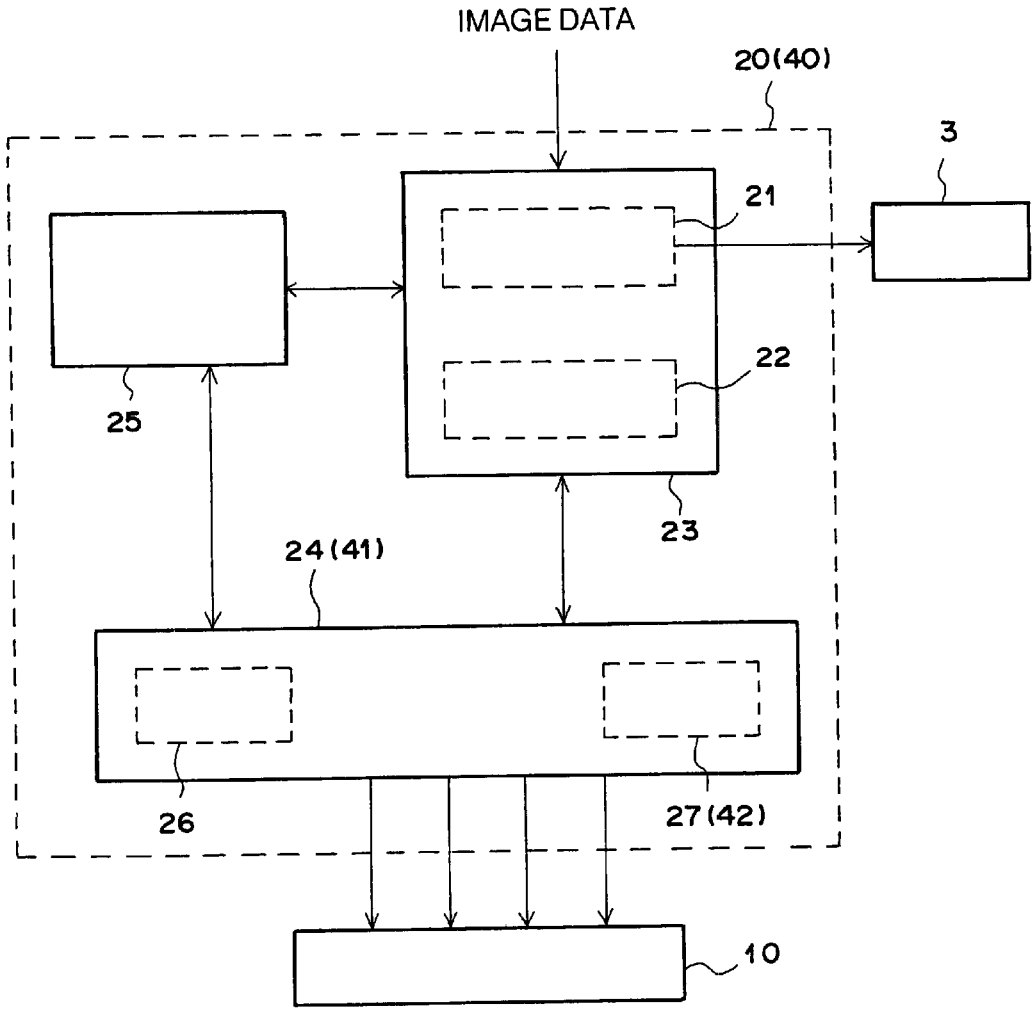
FIG. 5 is a block diagram of the controller.

As shown in FIG. 5, the controller 20 comprises a perforation control circuit 23 including a sub-scanning motor control circuit 21 which controls the sub-scanning motor 3 for rotating the platen roller 2 and an image processing circuit 22 which makes black-and-white image information for each pixel according to the input image data fraction, a thermal head control circuit 24 connected to the thermal head 10 and the perforation control circuit 23, and a system control circuit 25 which is connected to the thermal head 10 and the perforation control circuit 23 and controls the timing of total operation of the apparatus.

The thermal head control circuit 24 controls energizing the heater elements 11, thereby controlling heating of the heater elements 11, by outputting to the thermal head 10 clock signals CLK1 to CLK4, image data fractions DAT1 to DAT4 for selectively driving the heater elements 11, latch signals LAT1 to LAT4 for latching the image data fractions to the shift registers 16 and strobe signals STB1 to STB4 which govern the timing at which the latched image data fraction are output to the heater elements 11, and is provided with an auxiliary heating control circuit 26 and a preheating control circuit 27.

The auxiliary control circuit 26 outputs auxiliary heating data which causes each heater element 11 corresponding to a white pixel to heat to an auxiliary temperature, a temperature lower than a temperature at which the heater element 11 can form a perforation through which the ink can pass, when pixels adjacent to the pixel in the main scanning direction are black pixels. The preheating control circuit 27 outputs preheating data which causes each heater element 11 corresponding to a white pixel to heat to a preheating temperature, a temperature lower than a temperature at which the heater element 11 can form a perforation through which the ink can pass, when the pixel next to the pixel in the sub-scanning direction is a black pixel.

The operation of the stencil making apparatus in making a stencil by thermally perforating the stencil material 1 will be described hereinbelow.

When image data is input into the controller 20, the image processing circuit 22 of the perforation control circuit 23 makes black-and-white information for each pixel on the basis of the density represented by the image data and outputs black-and-white information for pixels for one stencil to the thermal head control circuit 24.

Figure 6:
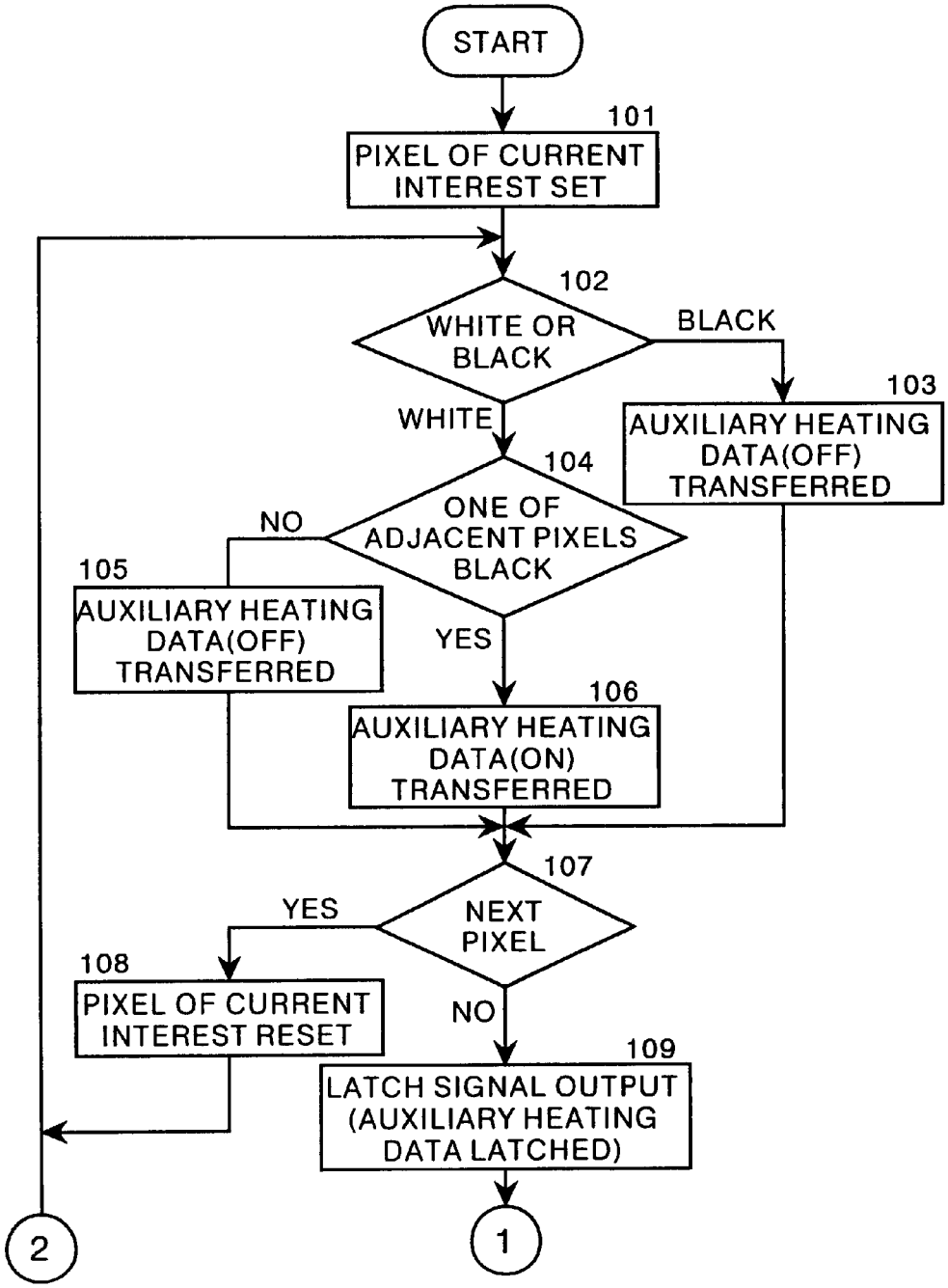
FIGS. 6 to 8 show a flow chart for illustrating the operation of the thermal heat control circuit in the first embodiment.
Figure 7:
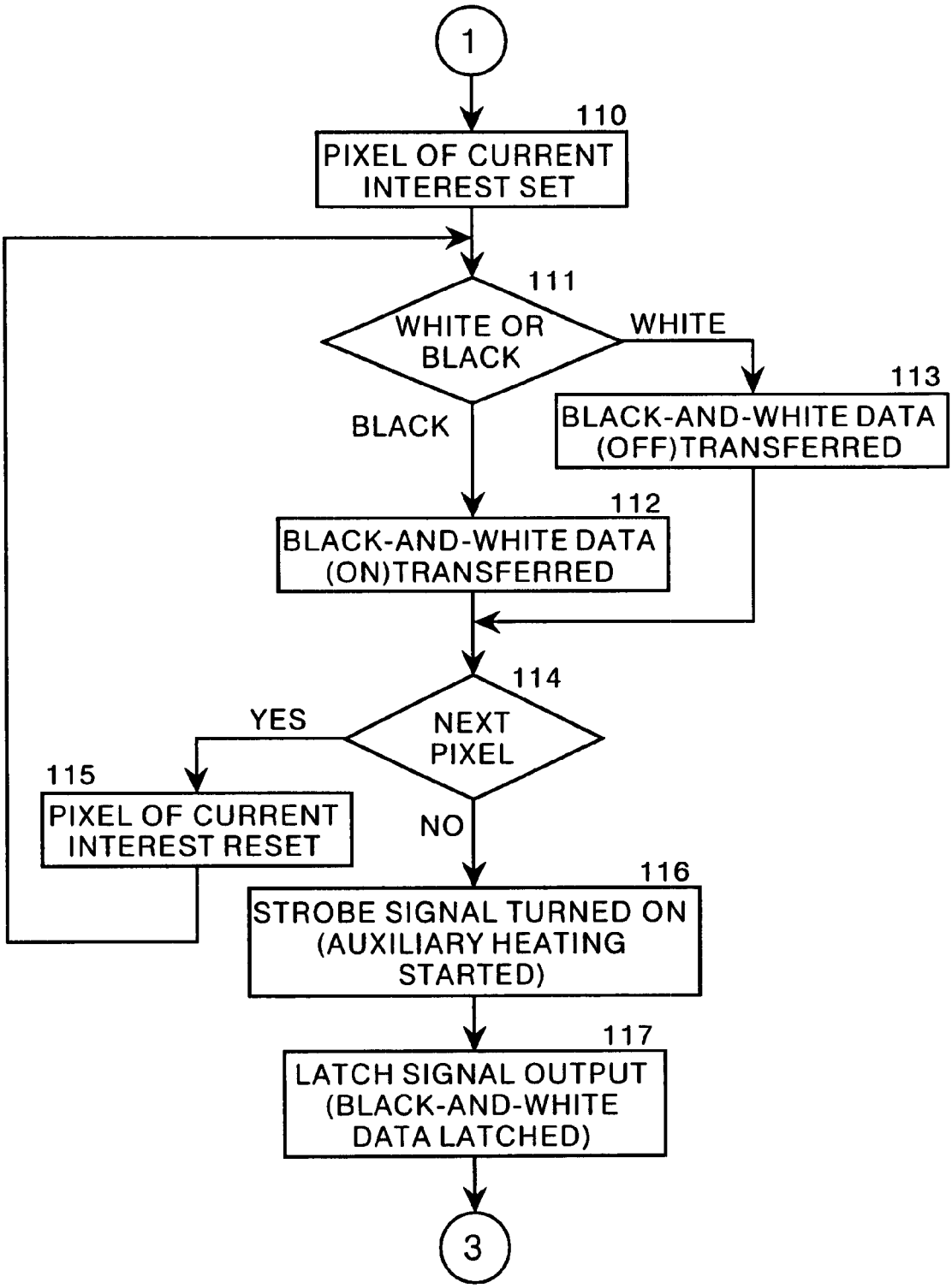
Figure 8:
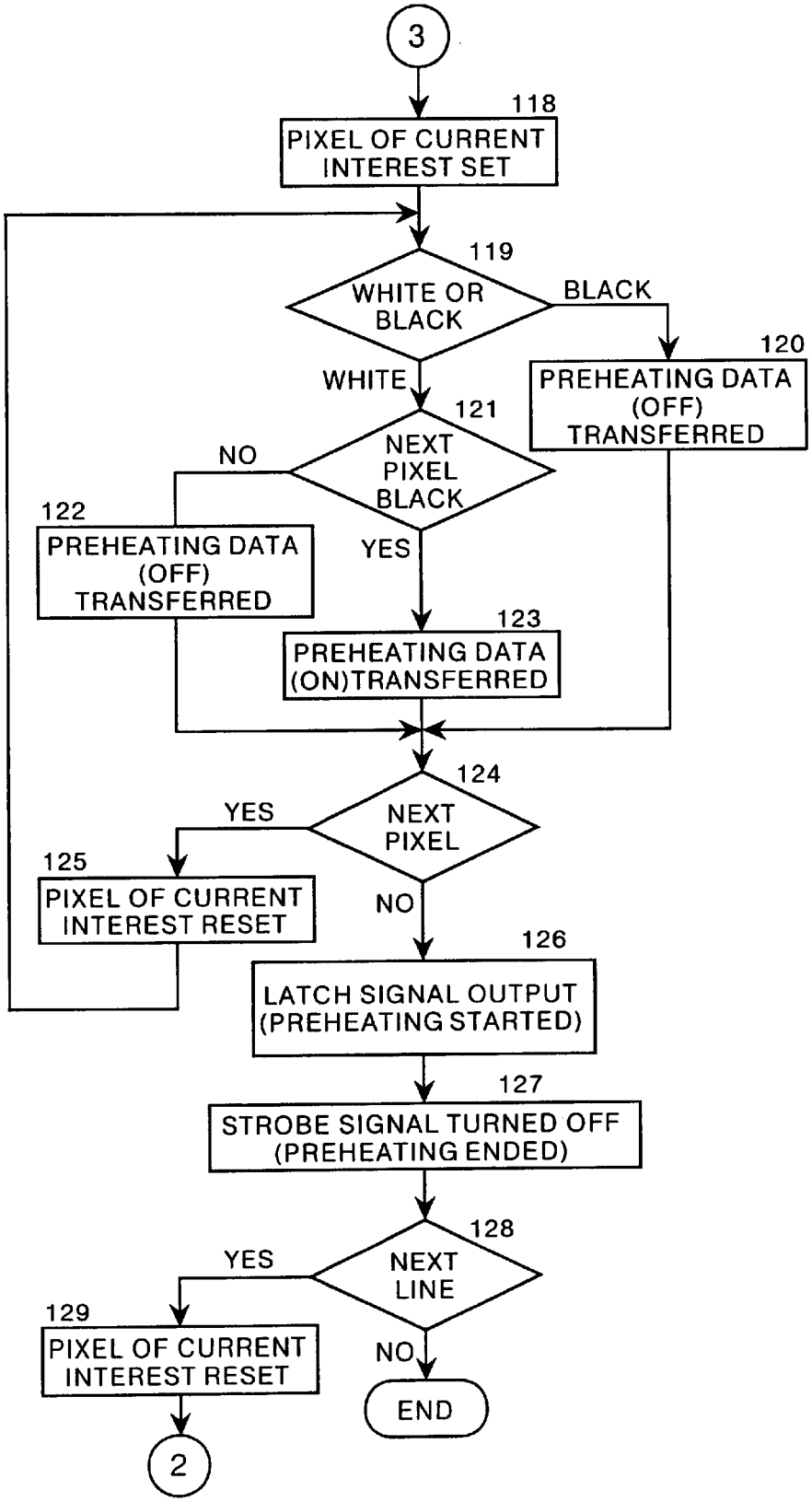

Description will be made mainly on the operation of the thermal head control circuit 24 with reference to the flow chart shown in FIGS. 6 to 8, hereinbelow. In the following description, image data DAT is used as representative of the image data fractions DAT1 to DAT4, a latch signal LAT is used as representative of the latch signals LAT1 to LAT4, and a strobe signal STB is used as representative of the strobe signals STB1 to STB4 for the purpose of simplification.

The thermal head control circuit 24 first sets as a pixel of current interest a pixel positioned leftmost in the main scanning direction on the uppermost sub-scanning line. (step 101) Then, in step 102, the thermal head control circuit 24 determines whether the pixel of current interest is white or black. When it is determined in step 102 that the pixel of current interest is white, the thermal head control circuit 24 executes step 104 and when it is determined in step 102 that the pixel of current interest is black, the thermal head control circuit 24 executes step 103. In step 103, the thermal head control circuit 24 transfers auxiliary heating data (off) as the serial image data (DAT) to the shift register 16 of the thermal head 10. Then the thermal head control circuit 24 executes step 107.

In step 104, the auxiliary heating control circuit 26 of the thermal head control circuit 24 determines whether the pixels adjacent to the pixel of current interest in the main scanning direction are black. When it is determined in step 104 that one of the two adjacent pixels is black, the auxiliary heating control circuit 26 executes step 106. When it is determined in step 104 that the two adjacent pixels are both black or both white, the auxiliary heating control circuit 26 executes step 105. In step 105, the thermal head control circuit 24 transfers auxiliary heating data (off) as the serial image data (DAT) to the shift register 16 of the thermal head 10. Then the thermal head control circuit 24 executes step 107. In step 106, the thermal head control circuit 24 transfers auxiliary heating data (on) as the serial image data (DAT) to the shift register 16 of the thermal head 10. Then the thermal head control circuit 24 executes step 107.

In step 107, the thermal head control circuit 24 determines whether another pixel exists downstream of the pixel of current interest in the main scanning direction. When it is determined in step 107 that a next pixel exists downstream of the pixel of current interest in the main scanning direction, the thermal head control circuit 24 sets the next pixel as the pixel of current interest in step 108 and repeats steps 102 to 107. Otherwise, the thermal head control circuit 24 executes step 109.

In step 109, the thermal head control circuit 24 outputs a latch signal LAT. The auxiliary heating data which has been transferred to the shift register 16 and has been expanded in parallel is latched by the latch signal LAT. Then the thermal head control circuit 24 executes step 110. In step 110, the thermal head control circuit 24 sets as a pixel of current interest a pixel positioned leftmost in the main scanning direction. Then, in step 111, the thermal head control circuit 24 determines whether the pixel of current interest is white or black. When it is determined in step 111 that the pixel of current interest is black, the thermal head control circuit 24 executes step 112 and when it is determined in step 111 that the pixel of current interest is white, the thermal head control circuit 24 executes step 113. In step 112, the thermal head control circuit 24 transfers black-and-white data (on) as the serial image data (DAT) to the shift register 16 of the thermal head 10. Then the thermal head control circuit 24 executes step 114. In step 113, the thermal head control circuit 24 transfers black-and-white data (off) as the serial image data (DAT) to the shift register 16 of the thermal head 10. Then the thermal head control circuit 24 executes step 114.

In step 114, the thermal head control circuit 24 determines whether another pixel exists downstream of the pixel of current interest in the main scanning direction. When it is determined in step 114 that a next pixel exists downstream of the pixel of current interest in the main scanning direction, the thermal head control circuit 24 sets the next pixel as the pixel of current interest in step 115 and repeats steps 111 to 114. Otherwise, the thermal head control circuit 24 executes step 116.

In step 116, the thermal head control circuit 24 turns on the strobe signal STB. The strobe signal STB causes the heater element 11 of the thermal head 10 to start being energized on the basis of the auxiliary heating data which has been latched in the latch section 15. That is, heater elements 11 whose latch sections 15 latch therein the auxiliary heating data (on) are energized and heated, and heater elements 11 whose latch sections 15 latch therein the auxiliary heating data (off) are not energized. The strobe signal STB is kept on until it is turned off in step 127.

Then in step 117, the thermal head control circuit 24 outputs latch signal LAT again a predetermined time after the strobe signal STB is turned on. The latch signal LAT latches in the latch section 15 black-and-white data which has been transferred to the shift register 16 and expanded in parallel. That is, the data latched in the latch section 15 is switched from the auxiliary heating data to the black-and-white data. Accordingly, the heater element 11 of the thermal head 10 starts to be heated on the basis of the black-and-white data. That is, heater elements 11 whose latch sections 15 latch therein the black-and-white data (on) are energized and heated, and heater elements 11 whose latch sections 15 latch therein the black-and-white data (off) are not energized.

In step 118, the thermal head control circuit 24 sets as a pixel of current interest a pixel positioned leftmost in the main scanning direction. Then, in step 119, the thermal head control circuit 24 determines whether the pixel of current interest is white or black. When it is determined in step 119 that the pixel of current interest is black, the thermal head control circuit 24 executes step 120 and when it is determined in step 119 that the pixel of current interest is white, the thermal head control circuit 24 executes step 121. In step 120, the thermal head control circuit 24 transfers preheating data (off) as the serial image data (DAT) to the shift register 16 of the thermal head 10. Then the thermal head control circuit 24 executes step 124.

In step 121, the preheating control circuit 27 of the thermal head control circuit 24 determines whether the pixel next to the pixel of current interest in the sub-scanning direction is black. When it is determined in step 121 that the next pixel is black, the preheating control circuit 27 executes step 123. When it is determined in step 121 that the next pixel is white, the preheating control circuit 27 executes step 122. In step 122, the thermal head control circuit 24 transfers preheating data (off) as the image data (DAT) to the shift register 16 of the thermal head 10. Then the thermal head control circuit 24 executes step 124.

In step 123, the thermal head control circuit 24 transfers preheating data (on) as the image data (DAT) to the shift register 16 of the thermal head 10. Then the thermal head control circuit 24 executes step 124. In step 124, the thermal head control circuit 24 determines whether another pixel exists downstream of the pixel of current interest in the main scanning direction. When it is determined in step 124 that a next pixel exists downstream of the pixel of current interest in the main scanning direction, the thermal head control circuit 24 sets the next pixel as the pixel of current interest in step 125 and repeats steps 119 to 124. Otherwise, the thermal head control circuit 24 executes step 126.

In step 126, the thermal head control circuit 24 outputs a latch signal LAT. The preheating data which has been transferred to the shift register 16 and has been expanded in parallel is latched by the latch signal LAT. That is, the data latched in the latch section 15 is switched from the black-and-white data to the preheating data. Accordingly, the heater element 11 of the thermal head 10 starts to be heated on the basis of the preheating data. That is, heater elements 11 whose latch sections 15 latch therein the preheating data (on) are energized and heated, and heater elements 11 whose latch sections 15 latch therein the preheating data (off) are not energized.

Then in step 127, the thermal head control circuit 24 turns off the strobe signal STB a predetermined time after the latch signal LAT is output in step 126 whereby heating according to the preheating data is stopped.

In step 128, the thermal head control circuit 24 determines whether another line exists in the sub-scanning direction. When it is determined in step 128 that a next line exists in the sub-scanning direction, the thermal head control circuit 24 sets the leftmost pixel on the next line as the pixel of current interest and returns to step 102. At this time, the sub-scanning motor 31 is rotated by one step under the control of the sub-scanning motor driving circuit 21 of the perforation control circuit 23, whereby the platen roller 2 conveys the stencil material 1 by one pixel pitch, 63.5 $\mu$m. Otherwise, the thermal head control circuit 24 ends processing.

Figure 9:
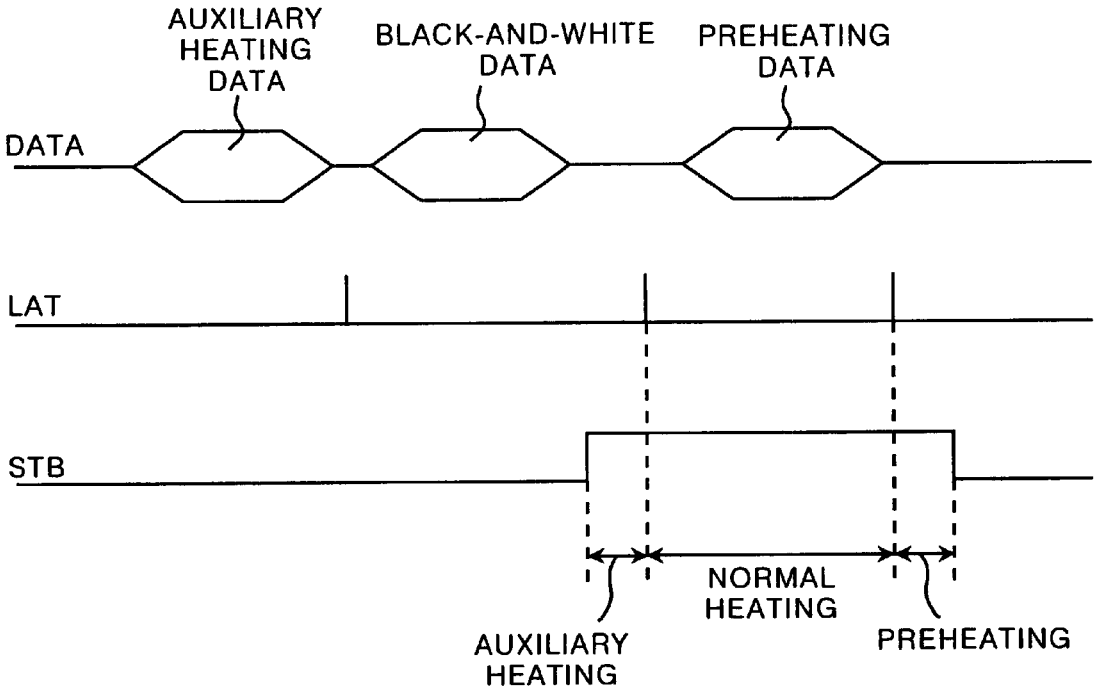
FIG. 9 is a view showing an example of the control signals output corresponding to the image data shown in FIG. 10.

With the control described above, auxiliary heating is effected on the basis of the auxiliary heating data from the time the strobe signal STB is turned on to the time the second latch signal LAT is output (110 $\mu$s in this particular embodiment), normal heating is effected on the basis of the black-and-white data from the time the second latch signal LAT is output to the time the third latch signal LAT is output (370 $\mu$s in this particular embodiment), and preheating is effected on the basis of the preheating data from the time the third latch signal LAT is output to the time the strobe signal STB is turned off (140 $\mu$s in this particular embodiment) as shown in FIG. 9.

The auxiliary heating on the basis of the auxiliary heating data or the preheating on the basis of the preheating data cannot form perforations permeable to ink since in such a heating, heating time is short.

Figure 10:
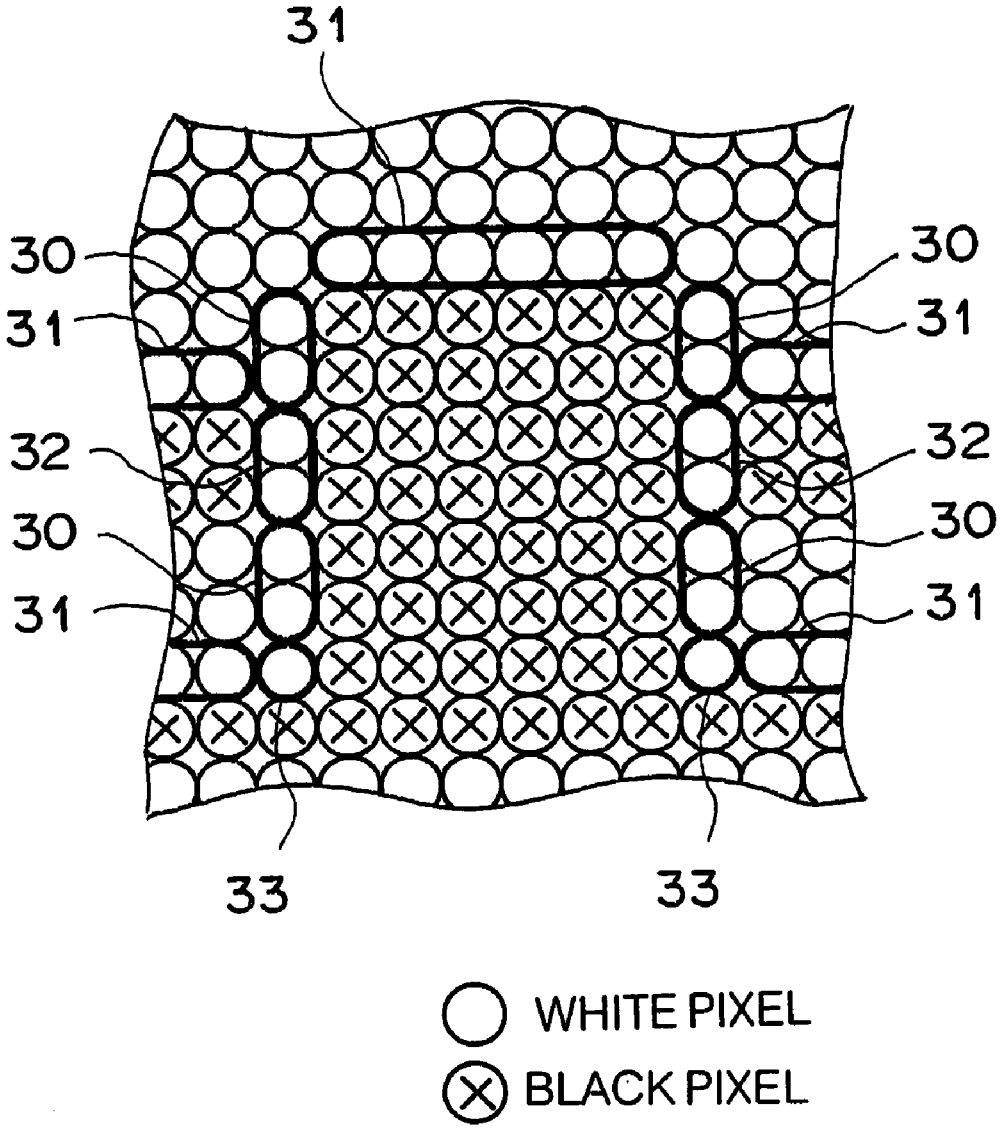
FIG. 10 is a view showing an example of the image data.

For example, assuming that the stencil material 1 is perforated on the basis of image data representing pixels arranged in the pattern shown in FIG. 10, when the pixel of current interest is black, the auxiliary heating data (off) is transferred to the shift register 16 (steps 102 and 103), the black-and-white data (on) is transferred to the shift register 16 (steps 111 and 112) and the preheating data (off) is transferred to the shift register 16 (steps 119 and 120). The heater element 11 is energized according to these pieces of data and only the normal heating on the basis of the black-and-white data (on) is effected.

When the pixel of current interest is a pixel such as in area 30 (FIG. 10) where each pixel is white, one of the pixels adjacent to the pixel in the main scanning direction is black and the pixel next to the pixel in the sub-scanning direction is white, the auxiliary heating data (on), the black-and-white data (off) and the preheating data (off) are transferred to the shift register 16 (steps 104 and 106, steps 111 and 113 and steps 121 and 122). The heater element 11 is energized according to these pieces of data and only the auxiliary heating on the basis of the auxiliary heating data (on) is effected. Accordingly, the heater element 11 is heated to an auxiliary temperature at which it cannot form a perforation permeable to the ink. However, though being heated only in the normal heating, the heater element 11 corresponding to the adjacent black pixel can be quickly heated, by virtue of the auxiliary heating of the heater element 11 corresponding to the pixel of current interest, to a temperature sufficient to perforation, whereby occurrence of defective perforation can be avoided. Further, the event that a particular heater element 11 is repeatedly heated for a long time can be avoided, and accordingly, the heater elements 11 are prevented from deteriorating.

When the pixel of current interest is a pixel such as in area 31 (FIG. 10) where each pixel is white, the two pixels adjacent to the pixel in the main scanning direction are both white and the pixel next to the pixel in the sub-scanning direction is black, the auxiliary heating data (off), the black-and-white data (off) and the preheating data (on) are transferred to the shift register 16 (steps 104 and 105, steps 111 and 113 and steps 121 and 123). The heater element 11 is energized according to these pieces of data and only the preheating on the basis of the preheating data (on) is effected. Accordingly, since having been heated to the preheating temperature, the heater element 11 corresponding to the adjacent black pixel can be quickly heated to a temperature sufficient to perforation, whereby occurrence of defective perforation can be avoided. Also when the pixels adjacent to the pixel of current interest in the main scanning direction are both black and the pixel next to the pixel of current interest in the sub-scanning direction is black, only the preheating on the basis of the preheating data (on) is effected in the same steps.

When the pixel of current interest is a pixel such as in area 32 (FIG. 10) where each pixel is white, the two pixels adjacent to the pixel in the main scanning direction are both black and the pixel next to the pixel in the sub-scanning direction is white, the auxiliary heating data (off), the black-and-white data (off) and the preheating data (off) are transferred to the shift register 16 (steps 104 and 105, steps 111 and 113 and steps 121 and 122). The heater element 11 is energized according to these pieces of data and no heating is effected. The heater elements 11 corresponding to these pixels can be heated to a temperature sufficient to form a perforation permeable to ink if the auxiliary heating is effected since the heater elements 11 on opposite sides thereof are heated in the normal heating. Accordingly, the auxiliary heating is not effected on such heater elements.

When the pixel of current interest is a pixel such as in area 33 (FIG. 10) where each pixel is white, one of the two pixels adjacent to the pixel in the main scanning direction is black and the pixel next to the pixel in the sub-scanning direction is black, the auxiliary heating data (on), the black-and-white data (off) and the preheating data (on) are transferred to the shift register 16 (steps 104 and 106, steps 111 and 113 and steps 121 and 123). The heater element 11 is energized according to these pieces of data and accordingly, both the auxiliary heating on the basis of the auxiliary heating data and the preheating on the basis of the preheating data are effected. Accordingly, the black pixels adjacent to the pixel of current interest in the main scanning direction or the sub-scanning direction can be successfully perforated. For other white pixels, the auxiliary heating data (off), the black-and-white data (off) and the preheating data (off) are transferred to the shift register 16 (steps 104 and 105, steps 111 and 113 and steps 121 and 122). The heater element 11 is energized according to these pieces of data and no heating is effected.

As can be understood from the description above, in the heat-sensitive stencil making apparatus of this embodiment, since the heater elements 11 which need not be heated to perforate the plate material (heater elements corresponding to white pixels) are heated to an auxiliary heating temperature according to the black and white information for pixels adjacent to the pixel in the main scanning direction, the heating temperature of a heater element which corresponds to a black pixel adjacent to a white pixel can be heated to a temperature close to a heating temperature of a heater element corresponding to a black pixel which is interposed between heater elements corresponding to black pixels without applying large energy to the heater element, fluctuation in the heating temperature of the heater elements can be suppressed and perforations can be uniform in size without deteriorating the durability of the thermal head.

Further, since the preheating control is performed in addition to the auxiliary heating control, a heater element 11 which comes to correspond to a black pixel after a white pixel can be heated to a temperature close to a heating temperature of a heater element successively corresponding to two black pixels without applying large energy to the heater element, whereby fluctuation in the heating temperature of the heater elements can be suppressed and perforations can be more uniform in size without deteriorating the durability of the thermal head.

Further since the auxiliary heating is performed prior to the timing at which heater elements corresponding to black pixels are heated to perforate the plate material, energy applied to the heater elements for the auxiliary heating can be efficiently used for perforation of the plate material.

Further, since fluctuation of the heating temperature from heater element 11 to heater element 11 can be suppressed by the preheating control, even in the case where there are a small number of black pixels in the vicinity of the pixel of current interest and perforations are less apt to be formed, small perforations can be uniformly formed with less defective perforations. Accordingly, by properly adjusting energy applied to the heater elements 11, the diameter of the perforations can be changed stepwise, which makes it feasible to change the printing density and to print in a plurality of gradations.

A heat-sensitive stencil making apparatus in accordance with a second embodiment of the present invention will be described, hereinbelow. The heat-sensitive stencil making apparatus of the second embodiment is substantially the same in the mechanical arrangement as that of the first embodiment. Accordingly, the elements different from those in the first embodiment in function are given different reference numerals in FIGS. 1 to 5 and the elements analogous to those in the first embodiment are given the same reference numerals and will not be described here unless necessary.

In the stencil making apparatus of this embodiment, an auxiliary heating control, in which each heater element corresponding to a white pixel is heated to an auxiliary temperature according to the black and white information for pixels adjacent to the pixel in the main scanning direction, and a heat history control, in which each heater element corresponding to a black pixel is additionally heated according to the black and white information for a pixel adjacent to the pixel in a sub-scanning direction on the preceding line (the pixel on the preceding line corresponding to the same heater element 11 as the pixel of current interest), are effected in combination.

As shown in FIG. 5, the controller 40 comprises a perforation control circuit 23 including a sub-scanning motor control circuit 21 which controls the sub-scanning motor 3 for rotating the platen roller 2 and an image processing circuit 22 which makes black-and-white image information for each pixel according to the input image data fraction, a thermal head control circuit 41 connected to the thermal head 10 and the perforation control circuit 23, and a system control circuit 25 which is connected to the thermal head 10 and the perforation control circuit 23 and controls the timing of total operation of the apparatus.

The thermal head control circuit 41 controls energizing the heater elements 11, thereby controlling heating of the heater elements 11, by outputting to the thermal head 10 clock signals CLK1 to CLK4, image data fractions DAT1 to DAT4 for selectively driving the heater elements 11, latch signals LAT1 to LAT4 for latching the image data fractions to the shift registers 16 and strobe signals STB1 to STB4 which govern the timing at which the latched image data fraction are output to the heater elements 11, and is provided with an auxiliary heating control circuit 26 and a heat history control circuit 42.

Each of the image data fractions DAT1 to DAT4 comprises a black-and-white data for instructing whether the stencil material is perforated, and auxiliary heating data and heat history data which are to be described later.

The signals are input into the heater element blocks at timings determined block by block as shown in FIG. 4. Data 1 on DAT4 in FIG. 4 represents the auxiliary heating data, data 2 represents the black-and-white data and data 4 represents the heat history data.

The operation of the stencil making apparatus in making a stencil by thermally perforating the stencil material 1 will be described hereinbelow. When image data is input into the controller 40, the image processing circuit 22 of the perforation control circuit 23 makes black-and-white information for each pixel on the basis of the density represented by the image data and outputs black-and-white information for pixels for one stencil to the thermal head control circuit 41.

Figure 11:
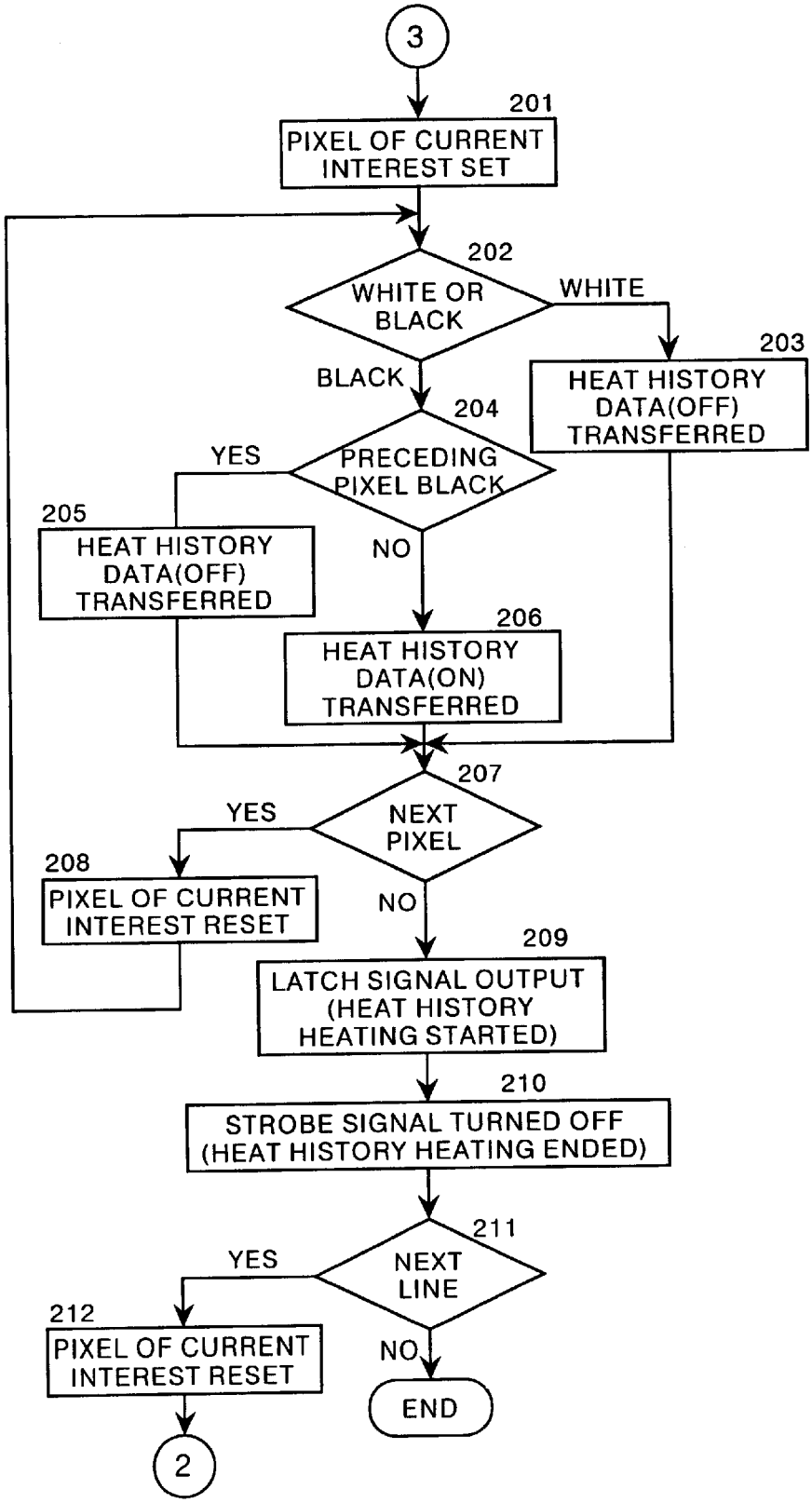
FIG. 11 is a flow chart for illustrating the operation of the thermal heat control circuit in the second embodiment together with FIGS. 6 and 7.

Description will be made mainly on the operation of the thermal head control circuit 41 with reference to the flow chart shown in FIGS. 6, 7 and 11, hereinbelow.

The operation of the thermal head control circuit 41 of this embodiment is the same as that of the thermal head control circuit 24 of the first embodiment in steps 101 to 117 shown in FIGS. 6 and 7, and accordingly, steps 201 to 212 shown in FIG. 11 only will be described hereinbelow.

In step 201, the thermal head control circuit 41 sets as a pixel of current interest a pixel positioned leftmost in the main scanning direction. Then, in step 202, the thermal head control circuit 41 determines whether the pixel of current interest is white or black. When it is determined in step 202 that the pixel of current interest is white, the thermal head control circuit 41 executes step 203 and when it is determined in step 202 that the pixel of current interest is black, the thermal head control circuit 41 executes step 204. In step 203, the thermal head control circuit 41 transfers heat history data (off) as the serial image data (DAT) to the shift register 16 of the thermal head 10. Then the thermal head control circuit 41 executes step 207.

In step 204, the heat history control circuit 42 of the thermal head control circuit 41 determines whether the preceding pixel (the pixel preceding to the pixel of current interest in the sub-scanning direction) is black. When it is determined in step 204 that the preceding pixel is not black, the heat history control circuit 42 executes step 206. When it is determined in step 204 that the preceding pixel is black, the heat history control circuit 42 executes step 205. In step 205, the thermal head control circuit 41 transfers heat history data (off) as the image data (DAT) to the shift register 16 of the thermal head 10. Then the thermal head control circuit 41 executes step 207.

In step 206, the thermal head control circuit 41 transfers heat history data (on) as the image data (DAT) to the shift register 16 of the thermal head 10. Then the thermal head control circuit 41 executes step 207. In step 207, the thermal head control circuit 41 determines whether another pixel exists downstream of the pixel of current interest in the main scanning direction. When it is determined in step 207 that a next pixel exists downstream of the pixel of current interest in the main scanning direction, the thermal head control circuit 41 sets the next pixel as the pixel of current interest in step 208 and repeats steps 202 to 207. Otherwise, the thermal head control circuit 41 executes step 209.

In step 209, the thermal head control circuit 41 outputs a latch signal LAT. The heat history data which has been transferred to the shift register 16 and has been expanded in parallel is latched by the latch signal LAT. That is, the data latched in the latch section 15 is switched from the black-and-white data to the heat history data. Accordingly, the heater element 11 of the thermal head 10 starts to be heated on the basis of the heat history data. That is, heater elements 11 whose latch sections 15 latch therein the heat history data (on) are energized and heated, and heater elements 11 whose latch sections 15 latch therein the preheating data (off) are not energized.

Then in step 210, the thermal head control circuit 41 turns off the strobe signal STB a predetermined time after the latch signal LAT is output in step 209 whereby heating according to the heat history data is stopped.

In step 211, the thermal head control circuit 41 determines whether another line exists in the sub-scanning direction. When it is determined in step 211 that a next line exists in the sub-scanning direction, the thermal head control circuit 41 sets the leftmost pixel on the next line as the pixel of current interest and returns to step 102. At this time, the sub-scanning motor 3 is rotated by one step under the control of the sub-scanning motor driving circuit 21 of the perforation control circuit 23, whereby the platen roller 2 conveys the stencil material 1 by one pixel pitch, 63.5 $\mu$m. Otherwise, the thermal head control circuit 41 ends processing.

Figure 12:
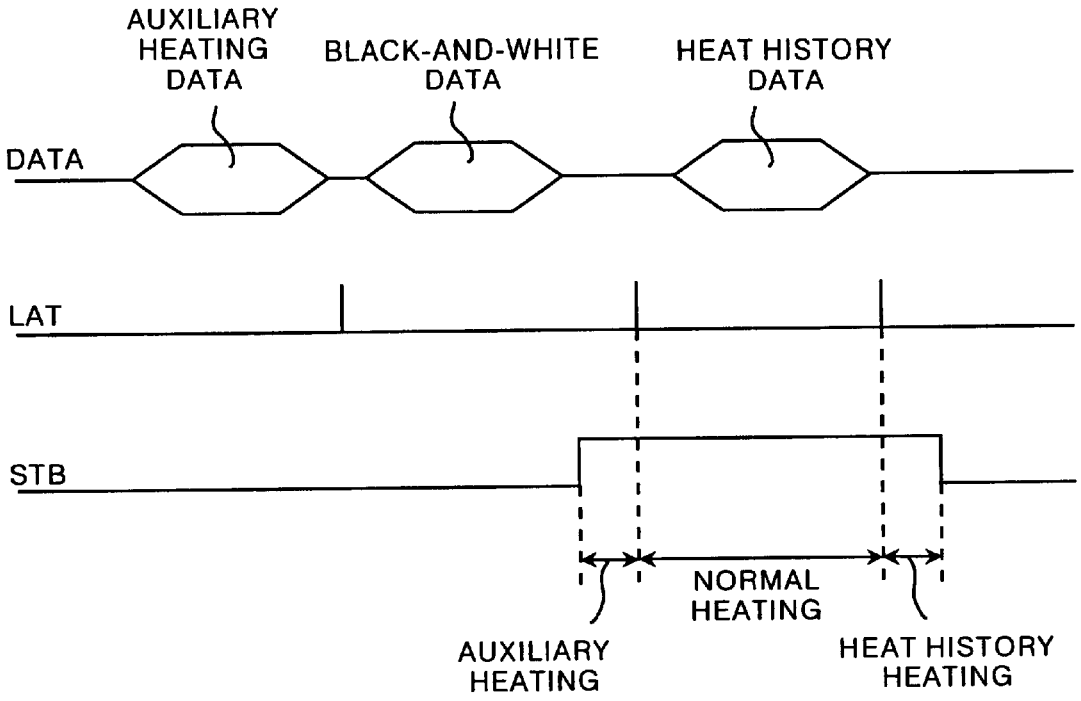
FIG. 12 is a view showing an example of the control signals output corresponding to the image data shown in FIG. 13.

With the control described above, auxiliary heating is effected on the basis of the auxiliary heating data from the time the strobe signal STB is turned on to the time the second latch signal LAT is output (110 μs in this particular embodiment), normal heating is effected on the basis of the black-and-white data from the time the second latch signal LAT is output to the time the third latch signal LAT is output (370 μs in this particular embodiment), and heat history heating is effected on the basis of the heat history data from the time the third latch signal LAT is output to the time the strobe signal STB is turned off (140 μs in this particular embodiment) as shown in FIG. 12.

The auxiliary heating on the basis of the auxiliary heating data cannot form perforations permeable to ink since in such a heating, heating time is short.

Figure 13:
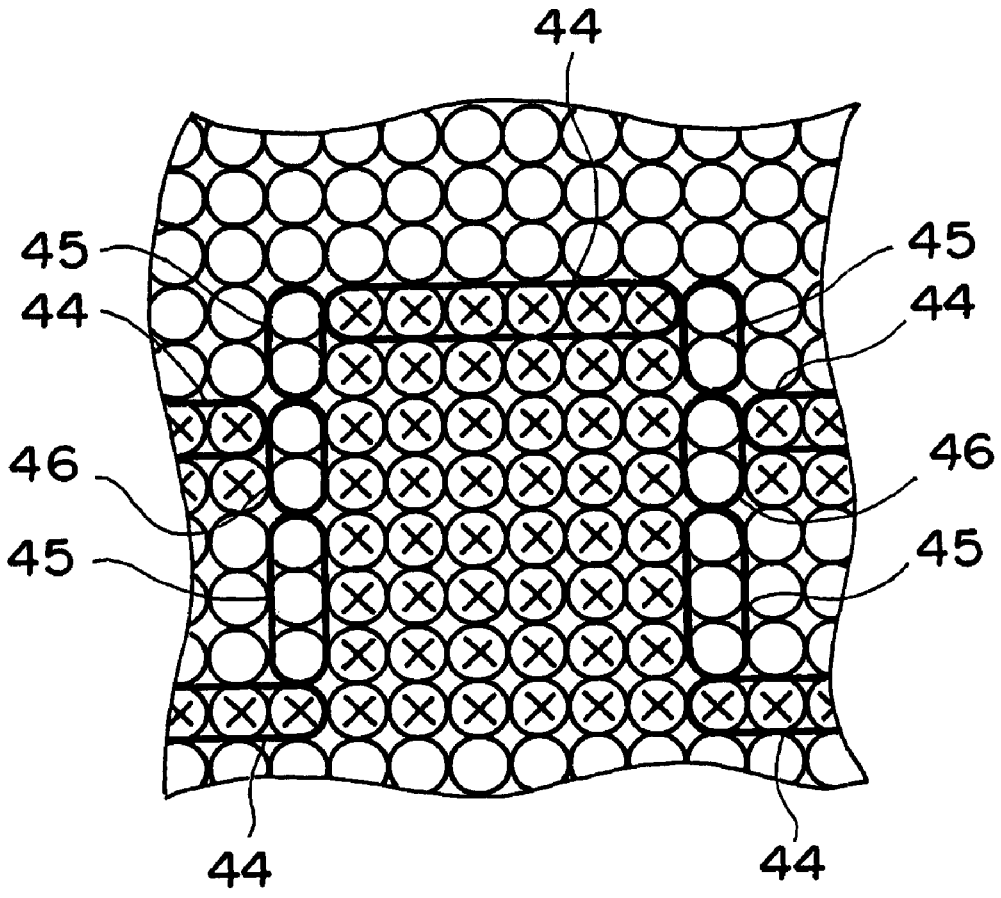
FIG. 13 is a view showing another example of the image data.

For example, assuming that the stencil material 1 is perforated on the basis of image data representing pixels arranged in the pattern shown in FIG. 13, when the pixel of current interest is black as a pixel in area 44 and the preceding pixel is white, the auxiliary heating data (off) is transferred to the shift register 16, the black-and-white data (on) is transferred to the shift register 16 and the heat history data (on) is transferred to the shift register 16. The heater element 11 corresponding to the pixel of current interest is heated in heat history heating in addition to the normal heating, and accordingly is energized for a longer time, whereby the heater element 11 is heated to a temperature close to a heating temperature of a heater element successively corresponding to two black pixels and occurrence of defective perforation can be prevented.

When the pixel of current interest is black and the preceding pixel is black, the auxiliary heating data (off), the black-and-white data (on) and the heat history data (off) are transferred to the shift register 16, and only the normal heating is effected.

When the pixel of current interest is a pixel such as in area 45 (FIG. 13) where each pixel is white and one of the pixels adjacent to the pixel in the main scanning direction is black, the auxiliary heating data (on), the black-and-white data (off) and the heat history data (off) are transferred to the shift register 16. The heater element 11 corresponding to the pixel of current interest is energized according to these pieces of data and only the auxiliary heating on the basis of the auxiliary heating data (on) is effected. Accordingly, the heater element 11 is heated to an auxiliary temperature at which it cannot form a perforation permeable to the ink. However, though being heated only in the normal heating, the heater element 11 corresponding to the adjacent black pixel can be quickly heated, by virtue of the auxiliary heating of the heater element 11 corresponding to the pixel of current interest, to a temperature sufficient to perforation, whereby occurrence of defective perforation can be avoided. Further, the event that a particular heater element 11 is repeatedly heated for a long time can be avoided, and accordingly, the heater elements 11 are prevented from deteriorating.

When the pixel of current interest is a pixel such as in area 46 (FIG. 13) where each pixel is white and the two pixels adjacent to the pixel in the main scanning direction are both black, the auxiliary heating data (off), the black-and-white data (off) and the heat history data (off) are transferred to the shift register 16 and no heating is effected. The heater elements 11 corresponding to these pixels can be heated to a temperature sufficient to form a perforation permeable to ink if the auxiliary heating is effected since the heater elements 11 on opposite sides thereof are heated in the normal heating. Accordingly, the auxiliary heating is not effected on such heater elements. For the heater elements 11 corresponding to other white pixels, the auxiliary heating data (off), the black-and-white data (off) and the heat history data (off) are transferred to the shift register 16 and no heating is effected.

As can be understood from the description above, in the heat-sensitive stencil making apparatus of this embodiment, since the heater elements 11 which need not be heated to perforate the plate material (heater elements corresponding to white pixels) are heated to an auxiliary heating temperature according to the black and white information for pixels adjacent to the pixel in the main scanning direction, the heating temperature of a heater element which corresponds to a black pixel adjacent to a white pixel can be heated to a temperature close to a heating temperature of a heater element corresponding to a black pixel which is interposed between heater elements corresponding to black pixels without applying large energy to the heater element, fluctuation in the heating temperature of the heater elements can be suppressed and perforations can be uniform in size without deteriorating the durability of the thermal head.

Further, since the heat history control is performed in addition to the auxiliary heating control, a heater element which comes to correspond to a black pixel after a white pixel can be heated to a temperature close to a heating temperature of a heater element successively corresponding to two black pixels, whereby fluctuation in the heating temperature of the heater elements can be suppressed and perforations can be further uniform in size without deteriorating the durability of the thermal head. Further since the heating time for the auxiliary heating control and the heating time for the heat history control can be set separately from each other, they can be finely controlled. Further, for instance, in the case where the pixel of current interest is black and an adjacent pixel is white, the heating temperature of the heater elements can be very finely adjusted by effecting very fine heat history control.

A heat-sensitive stencil making apparatus in accordance with a third embodiment of the present invention will be described, hereinbelow. The heat-sensitive stencil making apparatus of the third embodiment is substantially the same in the mechanical arrangement as that of the first embodiment. Accordingly, the elements different from those in the first embodiment in function are given different reference numerals in FIGS. 1 to 5 and the elements analogous to those in the first embodiment are given the same reference numerals and will not be described here unless necessary.

In the stencil making apparatus of this embodiment, an auxiliary heating control, in which each heater element corresponding to a white pixel is heated to an auxiliary temperature according to the black and white information for pixels adjacent to the pixel in the main scanning direction, and a heat history control, in which each heater element corresponding to a black pixel is additionally heated according to the black and white information for a pixel adjacent to the pixel in a sub-scanning direction on the preceding line (the pixel on the preceding line corresponding to the same heater element 11 as the pixel of current interest), are effected in combination and at the same timing.

Figure 14:
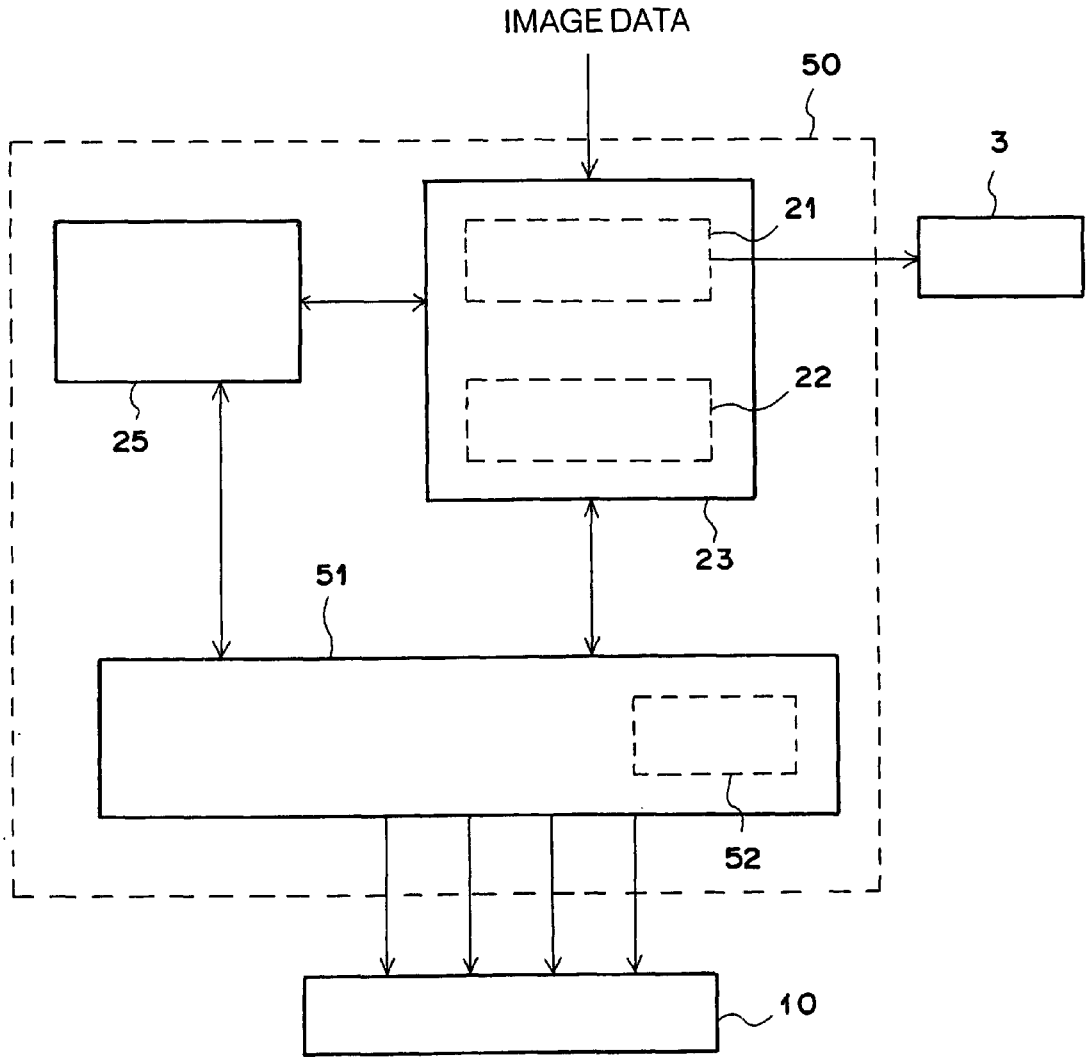
FIG. 14 is a block diagram of the controller.

In this embodiment, as shown in FIG. 14, the controller 50 comprises a perforation control circuit 23 including a sub-scanning motor control circuit 21 which controls the sub-scanning motor 3 for rotating the platen roller 2 and an image processing circuit 22 which makes black-and-white image information for each pixel according to the input image data fraction, a thermal head control circuit 51 connected to the thermal head 10 and the perforation control circuit 23, and a system control circuit 25 which is connected to the thermal head control circuit 51 and the perforation control circuit 23 and controls the timing of total operation of the apparatus.

The thermal head control circuit 51 controls energizing the heater elements 11, thereby controlling heating of the heater elements 11, by outputting to the thermal head 10 clock signals CLK1 to CLK4, image data fractions DAT1 to DAT4 for selectively driving the heater elements 11, latch signals LAT1 to LAT4 for latching the image data fractions to the shift registers 16 and strobe signals STB1 to STB4 which govern the timing at which the latched image data fraction are output to the heater elements 11, and is provided with an auxiliary heating/heat history control circuit 52.

Figure 15:
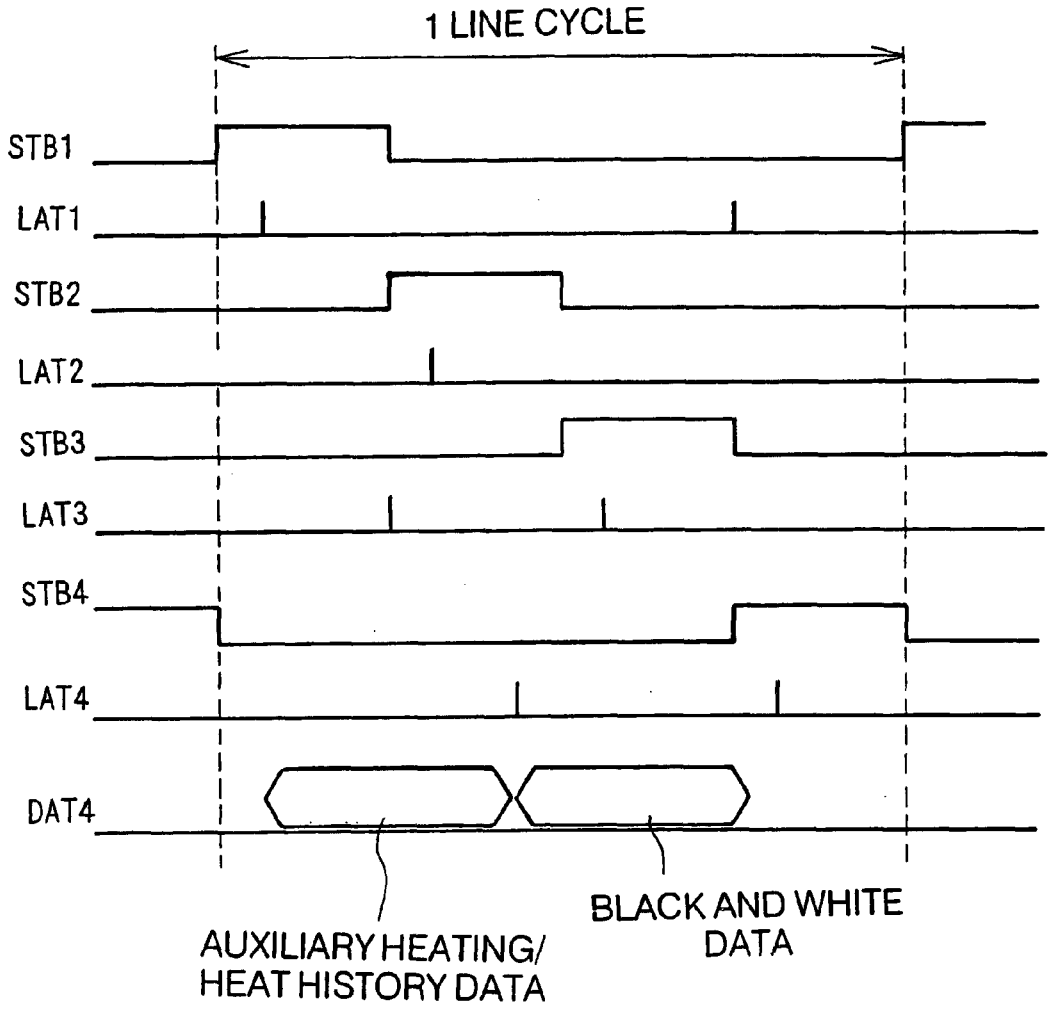
FIG. 15 is a view showing the control signals.

Each of the image data fractions DAT1 to DAT4 comprises a black-and-white data for instructing whether the stencil material is perforated, and auxiliary heating/heat history data. The signals are input into the heater element blocks at timings determined block by block as shown in FIG. 15.

The operation of the stencil making apparatus in making a stencil by thermally perforating the stencil material 1 will be described hereinbelow. When image data is input into the controller 50, the image processing circuit 22 of the perforation control circuit 23 makes black-and-white information for each pixel on the basis of the density represented by the image data and outputs black-and-white information for pixels for one stencil to the thermal head control circuit 51.

Figure 16:
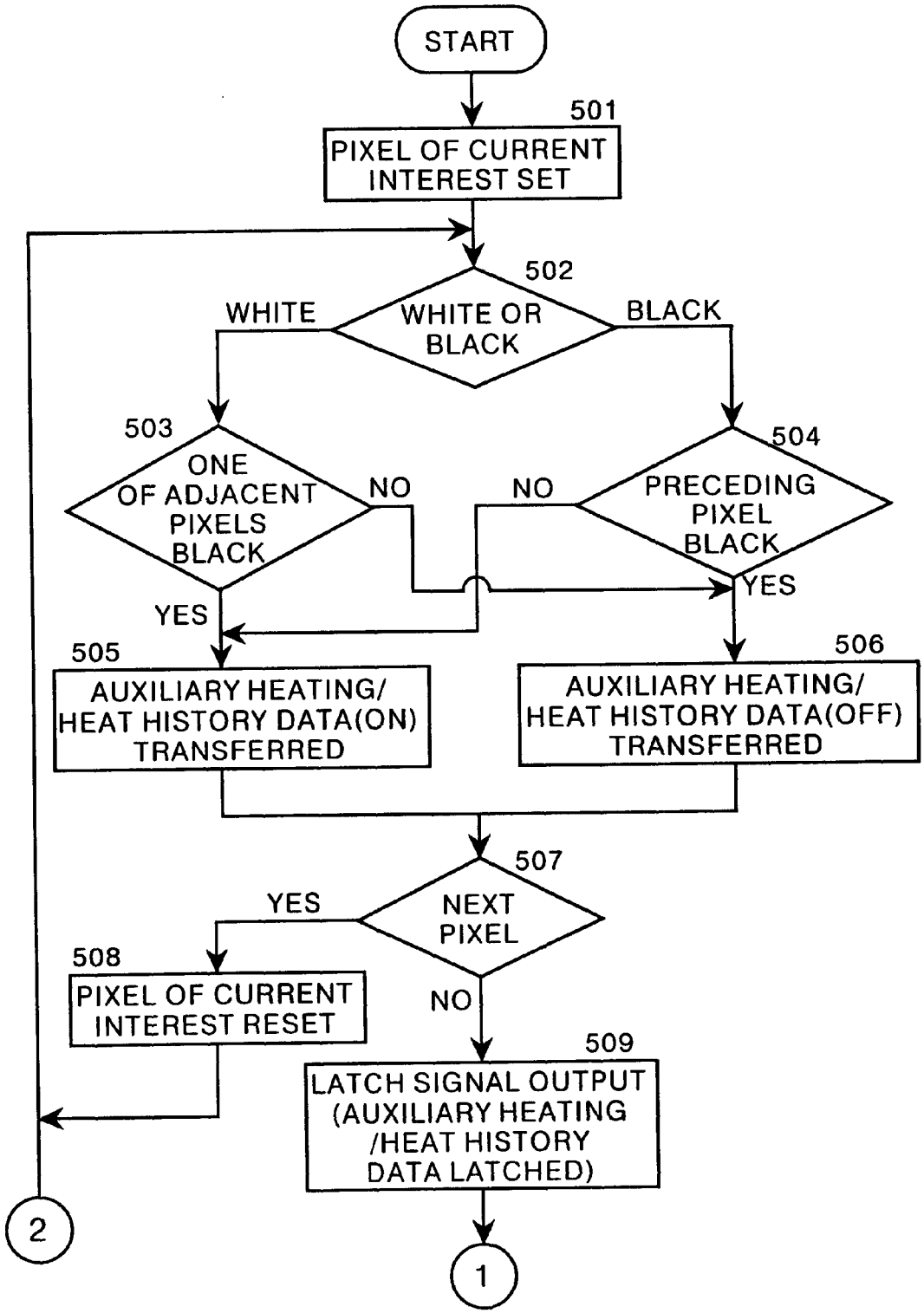
FIGS. 16 and 17 show a flow chart for illustrating the operation of the thermal heat control circuit in the third embodiment.
Figure 17:
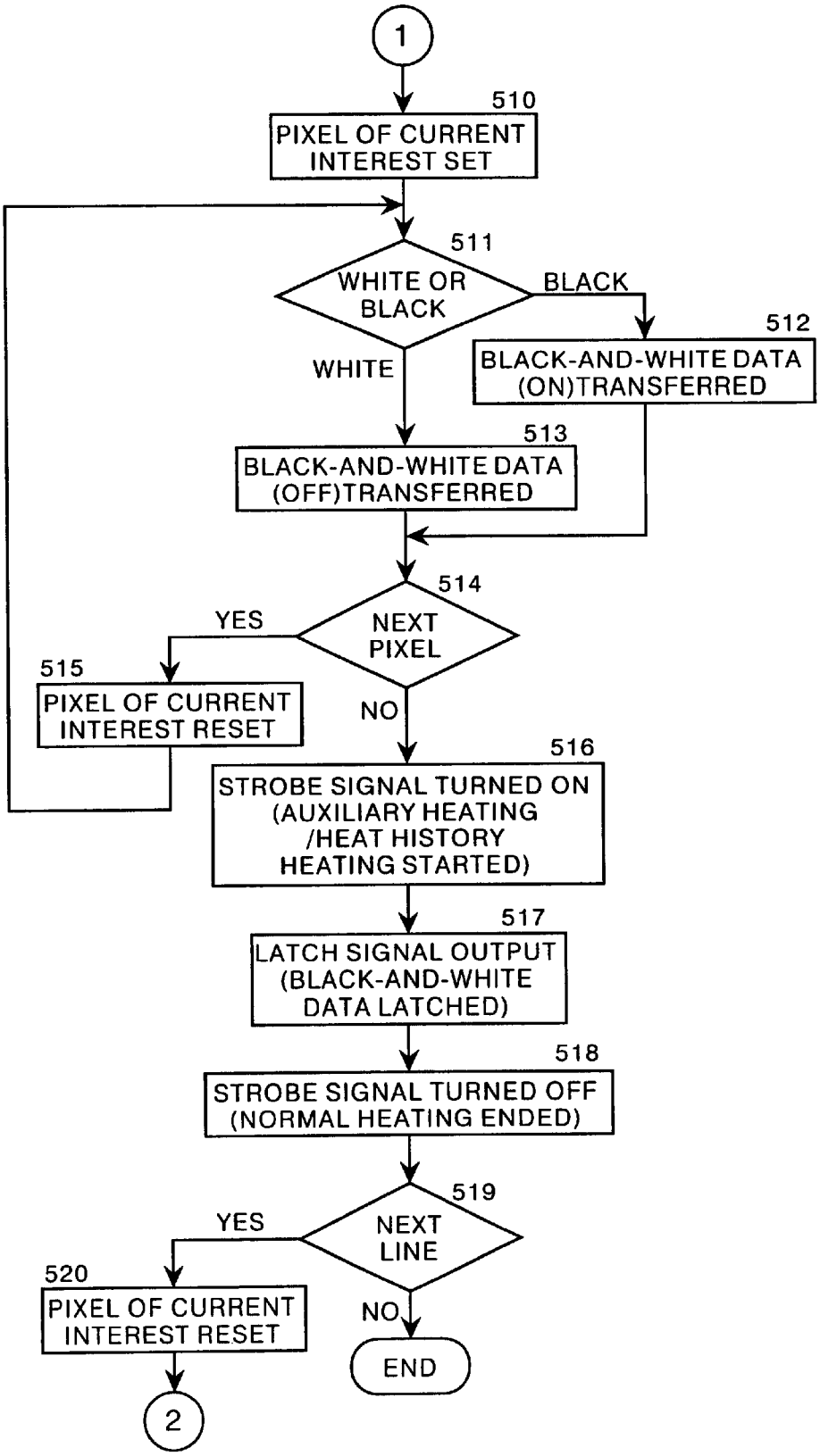

Description will be made mainly on the operation of the thermal head control circuit 51 with reference to the flow chart shown in FIGS. 16 to 17, hereinbelow. In the following description, image data DAT is used as representative of the image data fractions DAT1 to DAT4, a latch signal LAT is used as representative of the latch signals LAT1 to LAT4, and a strobe signal STB is used as representative of the strobe signals STB1 to STB4 for the purpose of simplification.

The thermal head control circuit 51 first sets as a pixel of current interest a pixel positioned leftmost in the main scanning direction on the uppermost sub-scanning line. (step 501) Then, in step 502, the thermal head control circuit 51 determines whether the pixel of current interest is white or black. When it is determined in step 502 that the pixel of current interest is white, the thermal head control circuit 51 executes step 503 and when it is determined in step 502 that the pixel of current interest is black, the thermal head control circuit 51 executes step 504.

In step 503, the auxiliary heating/heat history control circuit 52 of the thermal head control circuit 51 determines whether one of the pixels adjacent to the pixel of current interest in the main scanning direction are black. When it is determined in step 503 that one of the two adjacent pixels is black, the auxiliary heating/heat history control circuit 52 executes step 505. When it is determined in step 503 that the two adjacent pixels are both black or both white, the auxiliary heating/heat history control circuit 52 executes step 506.

In step 504, the auxiliary heating/heat history control circuit 52 of the thermal head control circuit 51 determines whether the pixel preceding to the pixel of current interest in the sub-scanning direction is black. When it is determined in step 504 that the preceding pixel is not black, the auxiliary heating/heat history control circuit 52 executes step 505. When it is determined in step 504 that the preceding pixel is black, the auxiliary heating/heat history control circuit 52 executes step 506.

In step 505, the thermal head control circuit 51 transfers auxiliary heating/heat history data (on) as the serial image data (DAT) to the shift register 16 of the thermal head 10. Then the thermal head control circuit 51 executes step 507.

In step 506, the thermal head control circuit 51 transfers auxiliary heating/heat history data (off) as the serial image data (DAT) to the shift register 16 of the thermal head 10. Then the thermal head control circuit 51 executes step 507.

In step 507, the thermal head control circuit 51 determines whether another pixel exists downstream of the pixel of current interest in the main scanning direction. When it is determined in step 507 that a next pixel exists downstream of the pixel of current interest in the main scanning direction, the thermal head control circuit 51 sets the next pixel as the pixel of current interest in step 508 and repeats steps 502 to 507. Otherwise, the thermal head control circuit 51 executes step 509.

In step 509, the thermal head control circuit 51 outputs a latch signal LAT. The auxiliary heating/heat history data which has been transferred to the shift register 16 and has been expanded in parallel is latched in the latch section 15 by the latch signal LAT. Then the thermal head control circuit 51 executes step 510.

In step 510, the thermal head control circuit 51 sets as a pixel of current interest a pixel positioned leftmost in the main scanning direction. Then, in step 511, the thermal head control circuit 51 determines whether the pixel of current interest is white or black. When it is determined in step 511 that the pixel of current interest is black, the thermal head control circuit 51 executes step 512 and when it is determined in step 511 that the pixel of current interest is white, the thermal head control circuit 51 executes step 513. In step 512, the thermal head control circuit 51 transfers black-and-white data (on) as the serial image data (DAT) to the shift register 16 of the thermal head 10. Then the thermal head control circuit 51 executes step 514. In step 513, the thermal head control circuit 51 transfers black-and-white data (off) as the serial image data (DAT) to the shift register 16 of the thermal head 10. Then the thermal head control circuit 51 executes step 514.

In step 514, the thermal head control circuit 51 determines whether another pixel exists downstream of the pixel of current interest in the main scanning direction. When it is determined in step 514 that a next pixel exists downstream of the pixel of current interest in the main scanning direction, the thermal head control circuit 51 sets the next pixel as the pixel of current interest in step 515 and repeats steps 511 to 514. Otherwise, the thermal head control circuit 51 executes step 516.

In step 516, the thermal head control circuit 51 turns on the strobe signal STB. The strobe signal STB causes the heater element 11 of the thermal head 10 to start being energized on the basis of the auxiliary heating/heat history data which has been latched in the latch section 15. That is, heater elements 11 whose latch sections 15 latch therein the auxiliary heating/heat history data (on) are energized and heated, and heater elements 11 whose latch sections 15 latch therein the auxiliary heating/heat history data (off) are not energized. The strobe signal STB is kept on until it is turned off in step 518.

Then in step 517, the thermal head control circuit 51 outputs latch signal LAT again a predetermined time after the strobe signal STB is turned on in step 516. The latch signal LAT latches in the latch section 15 black-and-white data which has been transferred to the shift register 16 and expanded in parallel. That is, the data latched in the latch section 15 is switched from the auxiliary heating/heat history data to the black-and-white data. Accordingly, the heater element 11 of the thermal head 10 starts to be heated on the basis of the black-and-white data. That is, heater elements 11 whose latch sections 15 latch therein the black-and-white data (on) are energized and heated, and heater elements 11 whose latch sections 15 latch therein the black-and-white data (off) are not energized.

In step 518, the thermal head control circuit 51 turns off the strobe signal STB a predetermined time after the latch signal LAT is output in step 517 whereby heating according to the black-and-white data is stopped.

In step 519, the thermal head control circuit 51 determines whether another line exists in the sub-scanning direction. When it is determined in step 519 that a next line exists in the sub-scanning direction, the thermal head control circuit 51 sets the leftmost pixel on the next line as the pixel of current interest and returns to step 502. At this time, the sub-scanning motor 3 is rotated by one step under the control of the sub-scanning motor driving circuit 21 of the perforation control circuit 23, whereby the platen roller 2 conveys the stencil material 1 by one pixel pitch, 63.5 $\mu$m. Otherwise, the thermal head control circuit 51 ends processing.

Figure 18:
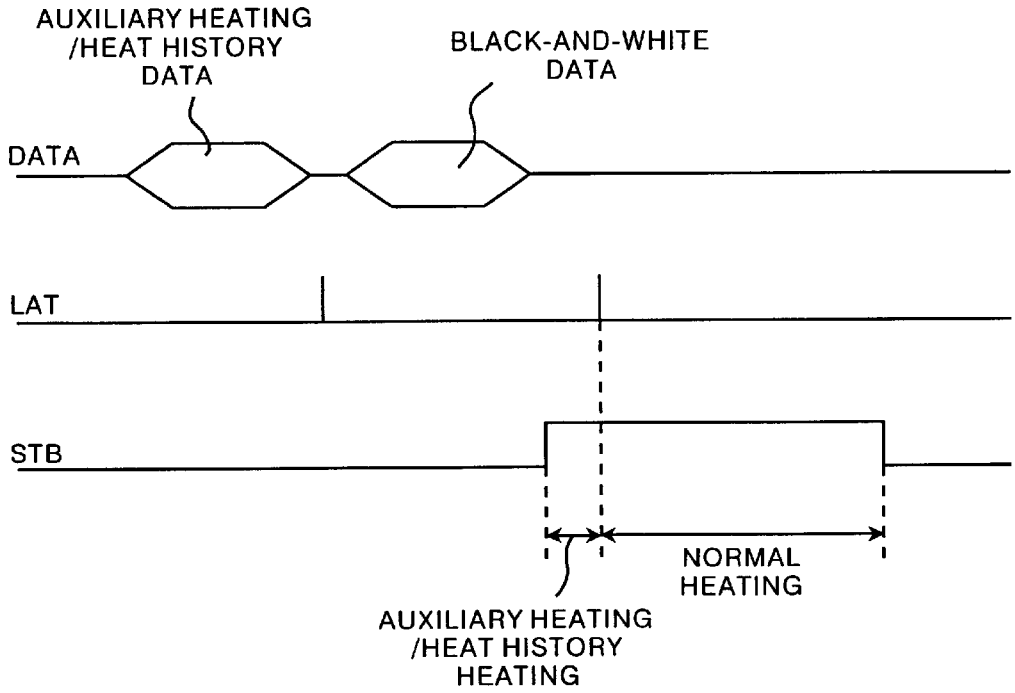
FIG. 18 is a view showing an example of the control signals output corresponding to the image data shown in FIG. 19.

With the control described above, heating is effected on the basis of the auxiliary heating/heat history data from the time the strobe signal STB is turned on to the time the second latch signal LAT is output (130 $\mu$s in this particular embodiment) and normal heating is effected on the basis of the black-and-white data from the time the second latch signal LAT is output to the time the strobe signal STB is turned off (370 $\mu$s in this particular embodiment) as shown in FIG. 18.

The auxiliary heating on the basis of the auxiliary heating data cannot form perforations permeable to ink since in such a heating, heating time is short. Further since the auxiliary heating control is basically effected on heater elements 11 corresponding to white pixels and the heat history control is basically effected on heater elements 11 corresponding to black pixels, they can be effected at the same timing.

Figure 19:
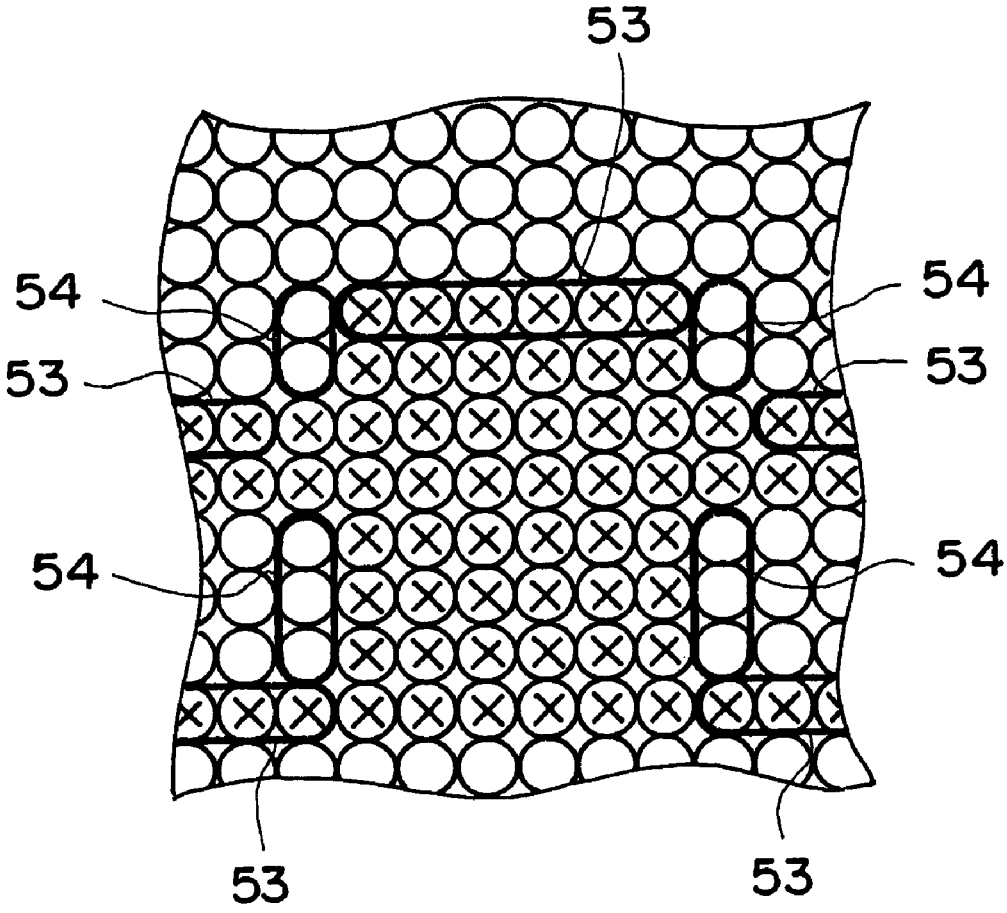
FIG. 19 is a view showing still another example of the image data.

For example, assuming that the stencil material 1 is perforated on the basis of image data representing pixels arranged in the pattern shown in FIG. 19, when the pixel of current interest is a pixel such as in area 54 (FIG. 19) where each pixel is white and one of the pixels adjacent to the pixel in the main scanning direction is black, the auxiliary heating/heat history data (on) is transferred to the shift register 16 (steps 502, 503 and 505) and the black-and-white data (off) is transferred to the shift register 16 (steps 511 and 513). The heater element 11 is energized according to these pieces of data and only the heating on the basis of the auxiliary heating/heat history data (on) is effected. Accordingly, the heater element 11 cannot form a perforation permeable to the ink. However, though being heated only in the normal heating, the heater element 11 corresponding to the adjacent black pixel can be quickly heated, by virtue of the heating of the heater element 11 corresponding to the pixel of current interest in the area 54 on the basis of the auxiliary heating/heat history data, to a temperature sufficient to perforation, whereby occurrence of defective perforation can be avoided. Further, the event that a particular heater element 11 is repeatedly heated for a long time can be avoided, and accordingly, the heater elements 11 are prevented from deteriorating. For other white pixels, the auxiliary heating/heat history data (off) and the black-and-white data (off) are transferred to the shift register 16 (steps 502, 503 and 506). The heater element 11 is energized according to these pieces of data and no heating is effected.

When the pixel of current interest is a pixel such as in area 53 (FIG. 19) where each pixel is black, and the pixel preceding to each pixel is white, the auxiliary heating/heat history data (on) and the black-and-white data (on) are transferred to the shift register 16 (steps 502, 504, 505, 511 and 512). The heater element 11 is energized according to these pieces of data and heating on the basis of the auxiliary heating/heat history data and heating on the basis of the black-and-white data are both effected. Accordingly the heater element 11 is heated to a temperature sufficient to perforate the stencil material and occurrence of defective perforation can be prevented.

Further, in this embodiment, since the auxiliary heating control and the heat history control are performed at the same timing, the time for performing the heat history control need not be reserved separately from the time for performing the auxiliary heating control and accordingly, elongation of the line cycle in the sub-scanning direction can be avoided.

Though, in the embodiments described above, the auxiliary heating control, the preheating control and the heat history control are effected on the basis of black-and-white information for pixels adjacent to the pixel of current interest, these controls may be effected on the basis of black-and-white information for other pixels, e.g., pixels positioned in an oblique direction of the pixel of current interest or pixels adjacent to the pixel of current interest with one or more pixels intervening therebetween.

Figure 22A:
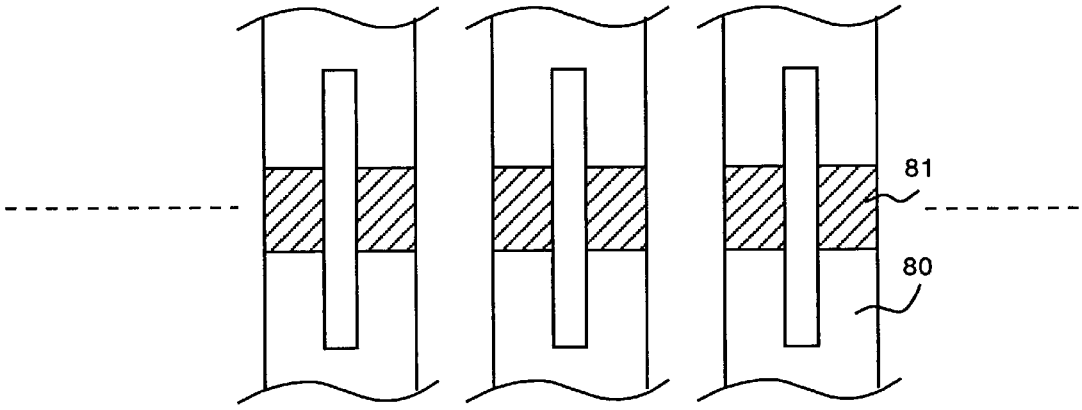
FIGS. 22A to 22C are plan views of various thermal heads.
Figure 22B:
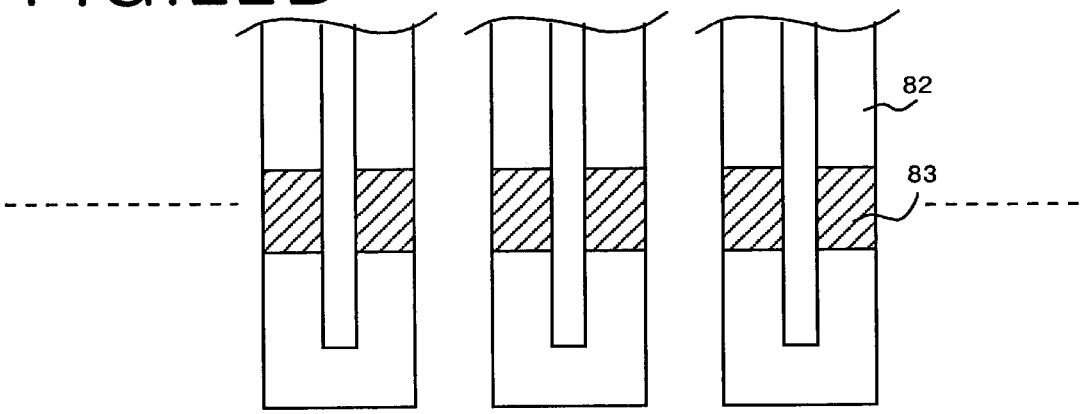
Figure 22C:
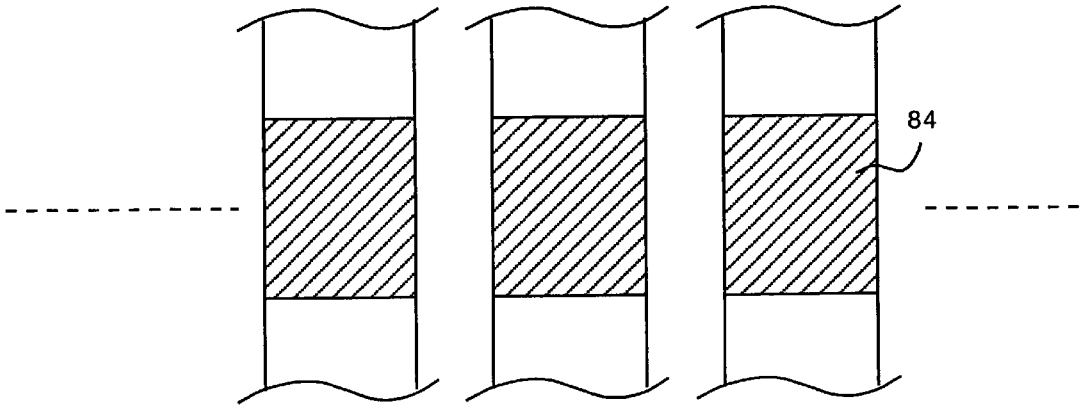
Figure 23A:
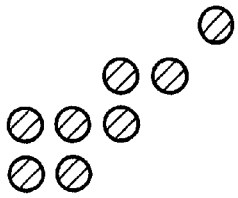
FIGS. 23A and 23B are views for illustrating perforations formed by different multiple-row thermal heads.
Figure 23B:
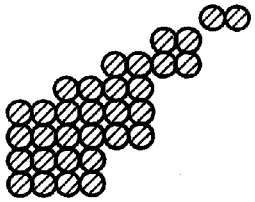
Figure 24A:
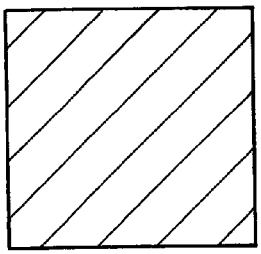
FIGS. 24A and 24B are views for illustrating the problem which arises when a multiple-row thermal head is controlled in the conventional way.
Figure 24B:
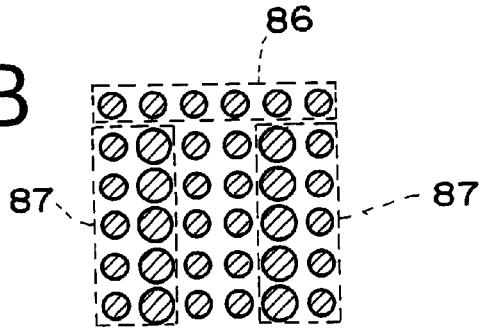

Further, though, in the embodiments described above, a single-row thermal head where one heater element corresponds to one pixel, is used, a multiple-row thermal head where a plurality of contiguous heater elements correspond to one pixel as shown in FIGS. 22A and 22B may be used. For example, when a multiple-row thermal head, where a pair of heater elements, each of which is 20 $\mu$m×25 $\mu$m (main scanning direction×sub-scanning direction), is used, satisfactory perforations can be obtained by applying power of 0.14 w to 0.16 w to each heater element. Further, when a multiple-row thermal head the resolution of which is 300 dpi in the main scanning direction is employed, the resolution in the sub-scanning direction can be 600 dpi.

Figure 20:
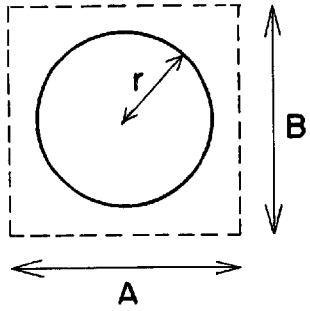
FIG. 20 is a view for illustrating the perforation factor.
Figure 21A:
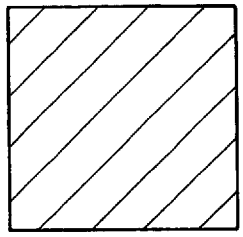
FIGS. 21A to 21C are views for illustrating the problem of the conventional art.
Figure 21B:
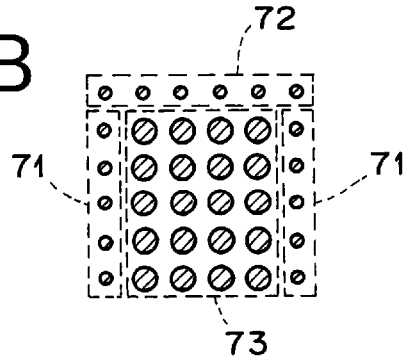
Figure 21C:
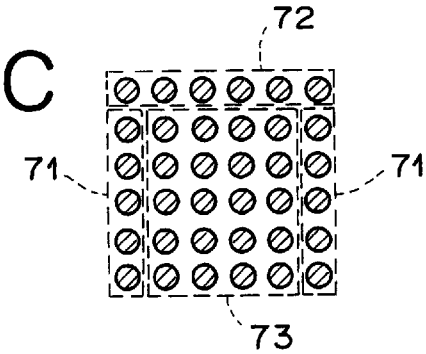

In the case where the line cycle was 2.048 ms, heating on the basis of the auxiliary heating/heat history data was effected for 130 $\mu$s, and heating on the basis of the black-and-white data was effected for 370 $\mu$s, the perforation factor was 27% when the energy applied to each heater element was 0.16 w and 24% when the energy applied to each heater element was 0.14 w. The perforation factor is the proportion of the area of the perforation $r^2\pi$ to the maximum area S (=A×B) as shown in FIG. 20.

Even when such a multiple-row thermal head is used, by effecting the auxiliary heating control, the heating temperature of a heater element which corresponds to a black pixel and which is adjacent to a heater element corresponding to a white pixel can be heated to a temperature close to a heating temperature of a heater element corresponding to a black pixel which is interposed between heater elements corresponding to black pixels, fluctuation in the heating temperature of the heater elements can be suppressed without deteriorating the durability of the thermal head and without generating oversized perforations. That is, when the thermal head is used in a heat-sensitive plate making apparatus, perforations can be uniform in size.

Further, when the conventional heat history control is not effected, even in the case where one of heater elements of a heater element pair corresponding to a black pixel adjacent to a white pixel is in contact with a heater element corresponding to a black pixel at the side remote from the white pixel, said one of heater elements of the heater element pair cannot be excessively heated, which prevents formation of oversized perforations.

What is claimed is:

1. A method of controlling a thermal head provided with a plurality of heater elements which are arranged in a main scanning direction, the method comprising the step of selectively energizing the heater elements according to black and white information for the pixels to be formed by the respective heater elements, wherein the improvement comprises the step of an auxiliary heating control in which each heater element corresponding to a pixel the black and white information for which is white is heated to an auxiliary temperature according to the black and white information for pixels adjacent to the pixel in the main scanning direction.

2. An apparatus for controlling a thermal head provided with a plurality of heater elements which are arranged in a main scanning direction, the apparatus comprising a heater control means which selectively energizes the heater elements according to black and white information for the pixels to be formed by the respective heater elements, wherein the improvement comprises that the heater control means is provided with an auxiliary heater control means which performs an auxiliary heating control in which each heater element corresponding to a pixel the black and white information for which is white is heated to an auxiliary temperature according to the black and white information for pixels adjacent to the pixel in the main scanning direction.

3. An apparatus as defined in claim 2 in which the heater control means is further provided with a preheating heater control means which performs a preheating control in which each heater element corresponding to a pixel the black and white information for which is white is heated to a preheating temperature according to the black and white information for pixels adjacent to the pixel in a sub-scanning direction substantially perpendicular to the main scanning direction.

4. An apparatus as defined in claim 2 in which the heater control means is further provided with a heat history heater control means which performs a heat history control in which each heater element corresponding to a pixel the black and white information for which is black is additionally heated on the basis of the black and white information for pixels adjacent to the pixel in the main scanning direction and/or a sub-scanning direction substantially perpendicular to the main scanning direction.

5. An apparatus as defined in claim 4 in which the auxiliary heater control means and the heat history heater control means perform the auxiliary heating control and the heat history control at the same timing.

6. An apparatus as defined in claim 2 in which the thermal head is used in a heat-sensitive plate making apparatus.

7. An apparatus as defined in claim 6 in which the auxiliary heater control means performs the auxiliary heating control so that each heater element corresponding to a pixel the black and white information for which is white is heated to an auxiliary temperature before heater elements corresponding to pixels the black and white information for which is black are heated to perforate the heat-sensitive plate material.

8. An apparatus as defined in claim 2 in which the thermal head is arranged so that a set of heater elements which are contiguously arranged in the main scanning direction and/or the sub-scanning direction form a single pixel.

* * * * *